US010830546B2

(12) United States Patent
Fleiner et al.

(10) Patent No.: US 10,830,546 B2
(45) Date of Patent: Nov. 10, 2020

(54) AUTOMATIC FIREARM GAS FEED APPARATUS

(71) Applicant: Heckler & Koch GmbH, Oberndorf/Neckar (DE)

(72) Inventors: Uwe Fleiner, Stuttgart (DE); Stefan Doll, Oberndorf (DE); Daniel Kohler, Oberndorf (DE); Wilhelm Fischbach, Deißlingen (DE)

(73) Assignee: HECKLER & KOCH GMBH, Oberndorf (DE)

( * ) Notice: Subject to any disclaimer, the term of this patent is extended or adjusted under 35 U.S.C. 154(b) by 0 days.

(21) Appl. No.: 15/914,904

(22) Filed: Mar. 7, 2018

(65) Prior Publication Data

US 2018/0259278 A1 Sep. 13, 2018

(30) Foreign Application Priority Data

Mar. 7, 2017 (DE) ..... 10 2017 002 165

(51) Int. Cl.
*F41A 5/28* (2006.01)
*F41A 5/26* (2006.01)

(52) U.S. Cl.
CPC . *F41A 5/28* (2013.01); *F41A 5/26* (2013.01)

(58) Field of Classification Search
CPC ..... F41A 5/28; F41A 5/26
USPC ..... 89/193
See application file for complete search history.

(56) References Cited

U.S. PATENT DOCUMENTS 2,582,989 A 1/1952 Harvey
3,592,101 A 7/1971 Vartanian et al.
4,503,632 A * 3/1985 Cuevas ..... F41A 21/28 42/1.06
5,824,943 A * 10/1998 Guhring ..... F41A 5/26 89/192
8,065,949 B1 * 11/2011 Molinari ..... F41A 5/28 89/193

(Continued)

FOREIGN PATENT DOCUMENTS

CH 250094 A 8/1947
DE 102006056130 A1 2/2008

(Continued)

OTHER PUBLICATIONS

European Patent Office, "European Search Report," dated Jul. 4, 2018 in connection with European Patent Application No. 18160522.1, 11 pages (Machine Translation Included).

(Continued)

*Primary Examiner* — Michelle Clement

(74) *Attorney, Agent, or Firm* — Hanley, Flight & Zimmerman, LLC

(57) ABSTRACT

Example apparatus are disclosed for a gas feed for an automatic firearm, the gas feed comprising a mounting portion to fasten the gas feed on a firearm barrel, the gas feed comprising a gas cylinder connectable to a barrel bore inside the firearm barrel via a gas channel, a gas piston disposed inside the gas cylinder to drive a gas operated reloading mechanism, wherein the gas piston is displaceable in a longitudinal direction with respect to the firearm, and a closure element that can be detachably coupled to an end of the gas cylinder adjacent a stock of the firearm, wherein the closure element comprises a passage through which a gas piston can be disposed.

14 Claims, 22 Drawing Sheets

(56) References Cited

U.S. PATENT DOCUMENTS

| | | | | |
|---|---|---|---|---|
| 8,869,674 | B2 | 10/2014 | Ruck et al. | |
| 8,893,608 | B2 * | 11/2014 | Kramer | F41A 5/26 89/193 |
| 9,243,856 | B2 * | 1/2016 | Audibert | F41A 5/18 |
| 9,273,916 | B1 * | 3/2016 | Russo | F41A 5/26 |
| 9,719,739 | B2 | 8/2017 | Windauer | |
| 9,766,027 | B1 * | 9/2017 | Cavanaugh | F41A 5/24 |
| 9,816,769 | B1 * | 11/2017 | Brown | F41A 21/28 |
| 2007/0199435 | A1 | 8/2007 | Hochstrate et al. | |
| 2010/0000400 | A1 | 1/2010 | Brown | |
| 2011/0094373 | A1 * | 4/2011 | Cassels | F41A 5/26 89/191.01 |
| 2014/0083286 | A1 | 3/2014 | Gomez | |
| 2018/0259278 | A1 * | 9/2018 | Fleiner | F41A 5/26 |

FOREIGN PATENT DOCUMENTS

| | | | |
|---|---|---|---|
| DE | 202015001384 | U1 | 3/2015 |
| EP | 0802388 | | 10/1997 |
| GB | 574607 | | 1/1946 |
| WO | 2006137874 | | 12/2006 |

OTHER PUBLICATIONS

European Patent Office, "Extended European Search Report," dated Nov. 15, 2018 in connection with European Patent Application No. 18160522.1, 15 pages, (Machine Translation Included).

German Patent and Trademark Office, "Office Action," issued in connection with German Patent Application No. 10 2017 002 165.1, dated Feb. 20, 2018, 6 pages (Machine Translation Included).

* cited by examiner

AUTOMATIC FIREARM GAS FEED APPARATUS

FIELD OF THE DISCLOSURE

This disclosure relates generally to a gas feed according to teachings disclosed herein. This disclosure relates more particularly to a firearm barrel equipped with a gas feed, as well as an automatic firearm with such a gas feed. In this disclosure, positional terms, such as "up," "down," "front," "rear," etc. always refer to an automatic firearm held in normal firing position, in which the axis of the bore runs horizontally and firing occurs forward away from the marksman.

BACKGROUND

Gas feeds for automatic firearms and firearm barrels equipped with them and automatic firearms, for example assault rifles, are known in a variety of designs.

As a rule, gas feeds are mounted on the firearm barrel approximately in the front third of the firearm barrel. In the process, a gas channel within the gas feed is brought into fluid connection with a bore in the firearm barrel, in order to divert propellant gases released upon firing for operation of a gas operated reloading mechanism from the firearm barrel. The firearm barrel is held and fixed in the interior of a firearm housing in a so-called barrel receiving area. Furthermore, in the firearm housing a longitudinally displaceably guided breech block assembly is provided for firing, extracting a fired cartridge case as well as for reloading.

The functional sequence for shooting and automatic reloading comprises the following simplified steps: For firing purposes, the breech block assembly, in particular its breech head, inserts a cartridge from a cartridge feed apparatus in known manner into a cartridge chamber in the barrel. When a trigger mechanism is actuated, a firing pin hits the cartridge base and ignites a propelling charge there, so that a projectile from the cartridge case is fired through the barrel. As soon as the projectile passes through the bore in the firearm barrel, the propellant gases released during the firing operation are diverted to the gas feed.

The diverted propellant gases are used to put the breech block assembly in known manner into a rearward motion. In the process, the propellant gases propel the breech assembly at a high speed to the rear in the direction of the stock via the gas feed and gas rod coupled to it. An ejector is provided on the breech head which encompasses a cartridge case on its edge on the case head and extracts it from the cartridge chamber in the rearward motion of the breech block assembly. An ejector then ejects the cartridge case from the firearm housing in known manner via a cartridge ejection port. In the forward motion of the breech block assembly a cartridge is fed to the cartridge chamber again and the cycle is repeated.

U.S. Pat. No. 3,592,101 discloses a gas-operated reloading system for an automatic firearm. Below a barrel a gas feed with a gas cylinder is provided which has a screwed in inserted part with gas passage on its muzzle-side end. A gas piston connected to an inertia body is inserted in the gas cylinder, said gas piston penetrating the stock-side end of the gas cylinder. A gas passage adjustment mechanism is not described or presented.

WO 2006/137874 A2 discloses an automatic firearm with a gas feed, in which a so-called short stroke gas piston is inserted into the gas cylinder open to the stock end, which after firing transmits an impulse via a spring-loaded gas rod to a breech block support. The propellant gas pressure can be regulated via a cylindrical adjustment device or a slide between the barrel bore and gas cylinder with cross-bores with variable cross-sectional diameter.

EP 0 802 388 B1 from the applicant discloses a class-specific gas feed for an automatic firearm. A short stroke gas piston is inserted into a gas cylinder open towards the stock. Outside of the gas cylinder the gas piston has a guide attachment on its stock-side end. A gas piston rod—called a push rod there—, is inserted in a bore in the receiving region adjoining the guide attachment. The gas piston has a valve pin on its muzzle-side end in order to vent propellant gases via a nozzle. A gas pressure adjustment is not described.

DETAILED DESCRIPTION

Figure 1:
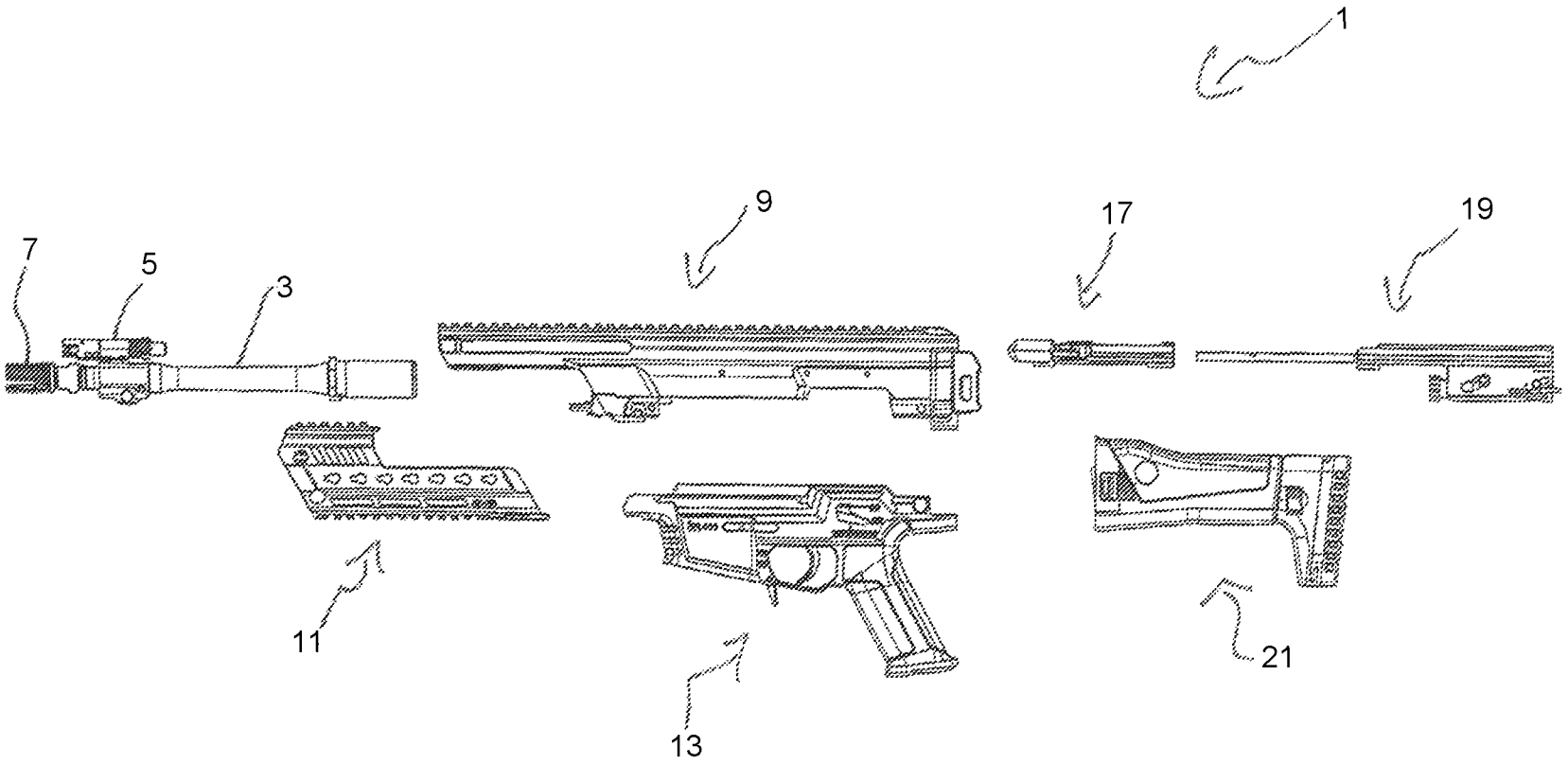
FIG. 1 is an exploded lateral view of an automatic firearm.

This disclosure addresses the problem of providing an alternative gas feed and a firearm barrel equipped with the gas feed and an automatic firearm with the gas feed. This problem is solved by the subject matters disclosed herein.

The category-defining gas feed is characterized in accordance with the teachings disclosed herein by the fact that on the end of the gas cylinder facing the stock of the firearm a closure element can be detachably coupled, said closure element having a passage for the gas piston.

The category-defining firearm barrel of this disclosure is characterized by the fact that it has a gas feed according to the teachings disclosed herein.

The category-defining automatic firearm of this disclosure is characterized by the fact that it has a gas feed according to the teachings of this disclosure.

The gas feed can be provided for various automatic firearms, for example for a machine gun, sniper rifle or an assault rifle. The gas feed is designed to propel a breech block assembly in particular via a gas rod.

The mounting portion of the gas feed comprises in its interior a cylindrical recess with complementary dimensions to the firearm barrel. For assembly the gas feed is slipped or placed on the firearm barrel and pinned in its storage position by means of a bore provided in the firearm barrel, said bore extending perpendicular to its longitudinal direction. Advantageously, with this embodiment it is not necessary for the gas feed to be welded onto the firearm barrel, so that there is also no delay.

The gas channel for supplying the propellant gases from the firearm barrel to the gas feed can extend vertically or diagonally to the longitudinal direction of the gas feed. If the gas channel extends diagonally to the longitudinal direction, the gas flow strikes the gas piston directly and drives it directly. In the case of a rectangular gas flow the gas pressure must first build up in the gas cylinder.

The gas piston can be a short stroke gas piston for a so-called indirect gas operating system, as is the case with the class-specific gas feed. A short stroke gas piston is characterized by a short path of motion, which is sufficient to transmit a corresponding drive pulse to the gas rod or the breech block assembly. The short stroke gas piston is not firmly connected to a gas rod of the breech block assembly. The closure element limits the piston stroke travel of the short stroke gas piston.

The closure element can be a cover, which can be placed on the barrel-side end of the gas cylinder and thus limits the inner volume of the gas cylinder. Externally the closure element can have a slip-resistant surface, for example with grip fins or as a saw tooth tread design for a better grip, in particular for operation with gloves or in a damp or dirty environment.

Due to the detachable coupling of the closure element it is possible to remove it without tools and to remove the gas piston from the gas cylinder, for example for cleaning purposes. A penetration of the passage in the closure element ensures the longitudinally displaceable movement of the gas piston.

The gas feed can be made of suitable materials, for example metal and its alloys. In particular, the gas feed can be manufactured, for example by an injection molding or casting method. Advantageously, the gas feed can be provided by extrusion molding or as an MIM part by a metal powder injection molding method. In the process, as a rule hardly any post-processing is necessary and an integral, sturdy construction is possible. This results in a cost reduction in production. Likewise, MIM parts have hardly any dimensional variations and thus reduce the expenditure in the case of any post-processing.

The gas feed can be adjusted without tools for operation with a silencer and can be equipped with an interface for 40 mm add-on grenade launcher, for example the HK269 grenade launcher.

Overall, a gas feed is provided with greater precision and dimensioning accuracy with low production tolerances. In the process, any desired design requirements for the gas feed can be implemented.

The detachable coupling of the closure element can occur via suitable fastening means, for example a threaded connection or a bayonet connection. The gas piston can be configured completely or partially complementary to the inner circumference of the gas cylinder with its outer dimensions to ensure sealing.

Preferably the gas piston comprises at least one gas piston bearing, and wherein the gas piston bearing comprises a sealant to seal the gas piston with respect to the gas cylinder.

The gas piston or short stroke gas piston can widen conically to form a gas piston bearing, so that at least one gas piston bearing segment, which extends completely or partially over the longitudinal direction of the gas cylinder, has a complementary segment approximating the inner circumference of the gas cylinder. When a sealant is inserted into this bearing segment the piston can be sealed against the gas cylinder, so that its return after firing is ensured. The sealant can for example be provided by at least one or more sealing rings which can be inserted into an annular recess provided in the gas piston bearing. Alternative suitable sealants can also be used.

Preferably an inner stop surface of the closure element is adjacent a counter stop surface of the gas piston bearing to limit return movement of the gas piston in a direction of a stock.

Advantageously, the stop defines the return path of the gas piston with repeatable accuracy. At the stop on the closure element the gas piston separates from the gas rod, so that the breech block assembly and the gas rod return separately. In the forward motion of the breech block assembly the gas rod comes back into contact with the gas piston and returns it to its initial position.

The inner stop surface can for example be provided as a rotary stop collar, in particular an annular stop collar. The inner stop surface can also have conically tapering insertion surfaces for the gas piston.

The counter stop surface on the gas piston is configured complementary to the stop surface, for instance being annular or tapered. Advantageously, this action provides with simple means a mobility of the gas piston over a defined path with repeatable accuracy.

Preferably, a region of the inner stop surface of the closure element comprises at least one recess to divert contaminants.

The one or more recesses can for example be bores in the passage for the gas piston or its stock in the closure element or cover, enabling a discharge of dirt particles. The recesses can for example be installed during manufacturing of the closure element or subsequently as bores or milled recesses.

This measure ensures with simple constructive means the functioning of the gas feed even under adverse conditions, for example under heavy contamination.

The fastening device can be achieved with suitable means, for example threaded connections.

Preferably, the fastening device is a fastening section on an outer circumference of the gas cylinder and adjacent to the stock, and wherein an interior of the closure element comprises a complementary fastening section, and wherein the fastening section and the complementary fastening section are bayonet joints.

The embodiment of a breech block section on the outer circumference of the gas cylinder, simplifies an attachment of the closure element. An embodiment as a bayonet breech enables with simple constructive means a detachable connection between the closure element and gas cylinder with repeatable accuracy.

The gas piston or short stroke gas piston can come into direct contact with the gas rod of the breech block assembly with its end penetrating the closure element.

Preferably, the connection between the gas piston and an attachment is secured by a safety element.

The attachment can for example be a cap, which, via a fastening means, for instance a threaded section, can be connected on the gas piston and a counter thread in the interior of the cap. Other suitable fastening modes are also possible. The cap comes into contact with the end of the gas bar and drives it, so that the cap, for instance in the case of wear, can be easily replaced.

Preferably however, the gas piston can be connected to an attachment via a fastening means on a bearing segment.

In addition to the threaded connection, a pin or wire or some other type of safety means can be provided as the safety element, which secures the closing cap on the stock end of the short stroke gas piston, for example by inserting the safety means into a bore.

The closure element or the cover can have an extension extending in the direction of the barrel muzzle, which is provided in particular for engagement with an elastic element.

Preferably, a muzzle-side end of the gas piston comprises a gas piston nose, and wherein the gas piston nose can be at least partially stored within a cylindrical multi-stage gas passage in the gas feed to allow longitudinal displacement.

The outside diameter of the gas piston shaft can taper in the direction of the barrel muzzle, so that the gas piston nose has a tubular gas passage provided on the gas feed in roughly complementary outer dimensions to the inside diameter.

Preferably, the cylindrical multi-stage gas passage is fluidly coupled to a gas outlet nozzle to divert propellant gases in a direction of a muzzle and outside of a firearm.

The interplay between the gas piston nose and gas passage and outlet nozzle enables a ventilation of excess propellant gases. As soon as the gas piston has moved so far after firing in the direction of the stock that propellant gases can penetrate into the gas passage between the gas piston nose and complementary gas passage on the gas cylinder, said gases are vented forward via the outlet nozzle in the direction of the barrel. The outlet nozzle can in particular be inserted into the gas feed as a carbide insert. This action enables a long service life of the gas nozzle.

In addition to the fluid connection between the gas passage and outlet nozzle, a gas outlet opening can be provided in the region between the gas passage and outlet nozzle in an additional gas channel. This action enables with simple constructive means a gas adjustment, wherein excess propellant gases are redirected or diverted to one or more gas outlet openings.

Preferably, a muzzle-side end of the gas feed comprises a gas adjustment apparatus encompassing a muzzle-side section of the gas feed, and wherein the gas adjustment apparatus can be at least fluidly coupled to the gas outlet nozzle for outgassing.

The gas adjustment apparatus can for example be an attachable gas adjustment sleeve which encompasses an in particular cylindrical outer section of the gas feed in the direction of the firearm barrel. A cylindrical embodiment of this outer section enables a simple adjustment of the gas adjustment sleeve by rotation.

Preferably, the gas adjustment apparatus can be detachably coupled to the gas feed via a fastening apparatus, and wherein the fastening apparatus is a bayonet joint.

This action enables with simple constructive means an attachment of the gas adjustment apparatus with repeatable accuracy as well as a secure fixing to the gas feed and a positive locking. Additionally, the bayonet breech enables an adjustment of the gas adjustment apparatus on the gas feed.

The bayonet breech can have an insertion guideway for a pin on the gas adjustment apparatus, so that the pin is inserted into the guideway when the gas adjustment sleeve is attached. When turned the pin can go into a circular rotary bayonet breech block section and is secured there against a longitudinal movement.

Preferably, the gas adjustment apparatus can be adjusted and indexed between at least two gas regulation positions via a safety device.

For adjustment purposes the gas adjustment apparatus can be rotated, in particular clockwise or counter-clockwise. The safety device can for example be a lock-in position or locking pin in order to prevent an unintended adjustment from the selected gas regulation position.

Preferably, the safety device is a U-shaped molded spring that can be inserted and fixed in complementary bearings in the gas feed.

The molded spring is also referred to as a stop spring and enables an elastic indexing of the gas adjustment sleeve in respective locking grooves. The molded spring can in particular be a U-shaped element, which encompasses a section of the gas feed. To this end, recesses can be provided in the interior of the molded spring, which are fixed or can be fixed as molded spring locks on complementary bearing segments of the gas feed. In addition, the molded spring can have a locking projection extending upward for indexing the gas adjustment sleeve.

The molded spring can have at least one extension extending in longitudinal direction on its lateral end, which is connected to the molded spring via an extension section. A locking projection can be provided at the rear end of the lateral extension, in particular a zig-zag shaped locking projection, which indexes the cover or the closure element and to this end engages with a counter recess in an extension of the closure section or cover.

The gas cylinder of the gas feed extends coaxially to the firearm barrel in its longitudinal direction.

Preferably the automatic firearm comprises a gas piston rod to detachably couple with the gas feed of the automatic firearm, and wherein the breech block assembly is disposed in the firearm housing and coupled to the gas rod to allow longitudinal displacement.

This action ensures with simple constructive means a secure function of the gas operated reloading mechanism.

The structure of an automatic firearm 1 will be explained with the aid of FIG. 1. FIG. 1 shows the automatic firearm 1 in an exploded view.

The automatic firearm is in the present case designed as an assault rifle (HK433) and comprises essentially the following elements: a firearm barrel 3 with a gas feed 5 mounted on it and a flash suppressor 7 (e.g., a flash damper); a firearm housing 9 (e.g., a firearm receiver), in which the firearm barrel 3 can be inserted; a hand guard 11 that can be coupled to the firearm housing 9 and a grip 13 that can be mounted on the firearm housing 9. Further, a loading device 17, a breech block assembly 19 and a shoulder support stock 21 that can be coupled on the firearm housing 9 are provided.

The individual assemblies or components and their functions are known per se. In other respects, regarding their functions reference is made to the patent application of the eponymous applicant under the title "Weapon Housing and Automatic Firearm equipped therewith and a Method for Manufacturing a Weapon Housing" with today's filing date.

Figure 2:
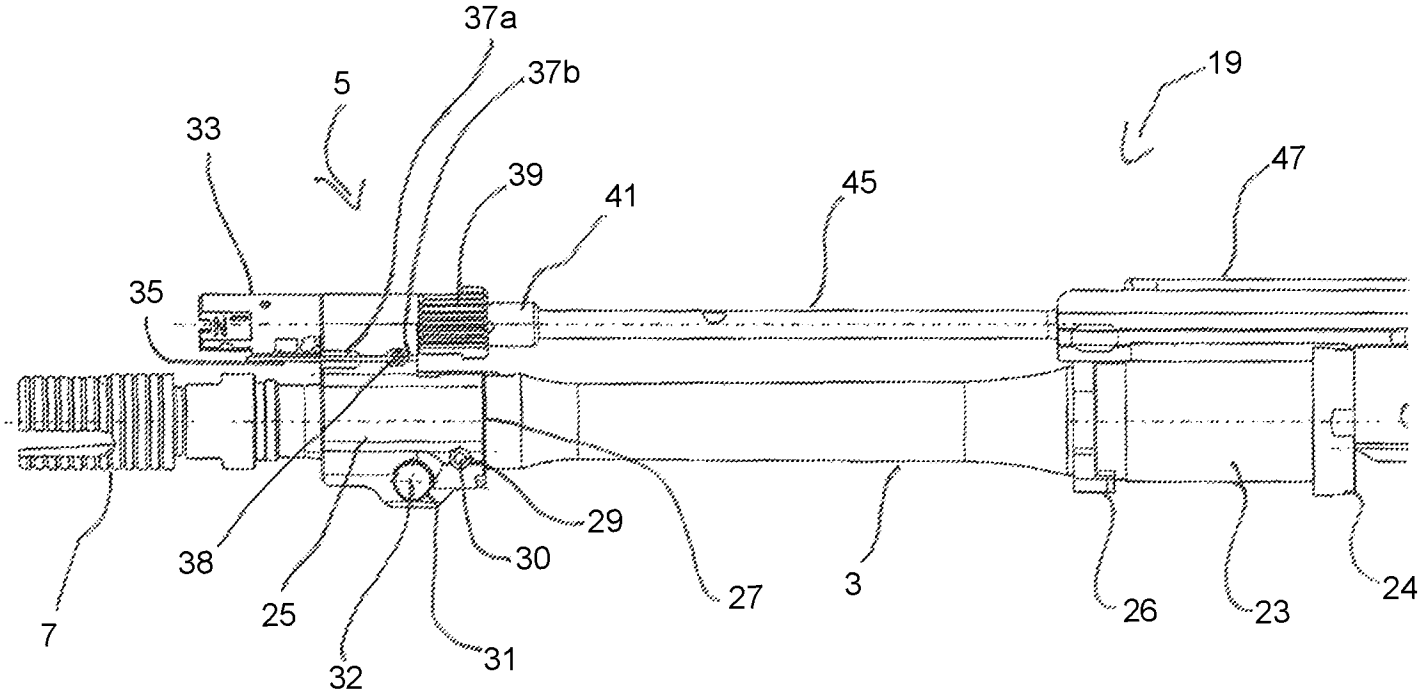
FIG. 2 is a lateral view of a gas feed mounted on a firearm barrel with parts of a breech block assembly.

FIG. 2 shows an enlarged detailed representation from FIG. 1 with the gas feed 5 mounted on the barrel 3. The barrel 3 comprises in its rear end a locking sleeve 23, on whose underside a locking and positioning pin 26 is provided and on whose rear end to the stock of the firearm a barrel nut 24 is attached. The locking sleeve 23 is inserted in a barrel receiving area not shown here and attached via the barrel nut 24. For details please refer to the aforementioned parallel application of the applicant.

The gas feed 5 comprises a cylindrical barrel bearing 27 for assembly on the firearm barrel 3. To this end the flash suppressor 7 is removed or unscrewed and the gas feed 5 is slipped on. For fixation of the gas feed 5 a bearing bore 29 diagonally penetrating said gas feed is provided as a bearing for a cross pin 30, which fixes the gas feed 5. In the perspective representations of FIGS. 10 and 11 the bearing bore 29 is shown in detail. Adjacent to this a bore 31 is provided as a bearing for a retaining bolt 32 for fastening an attachment, for example a 40 mm HK grenade launcher.

Figure 13B:
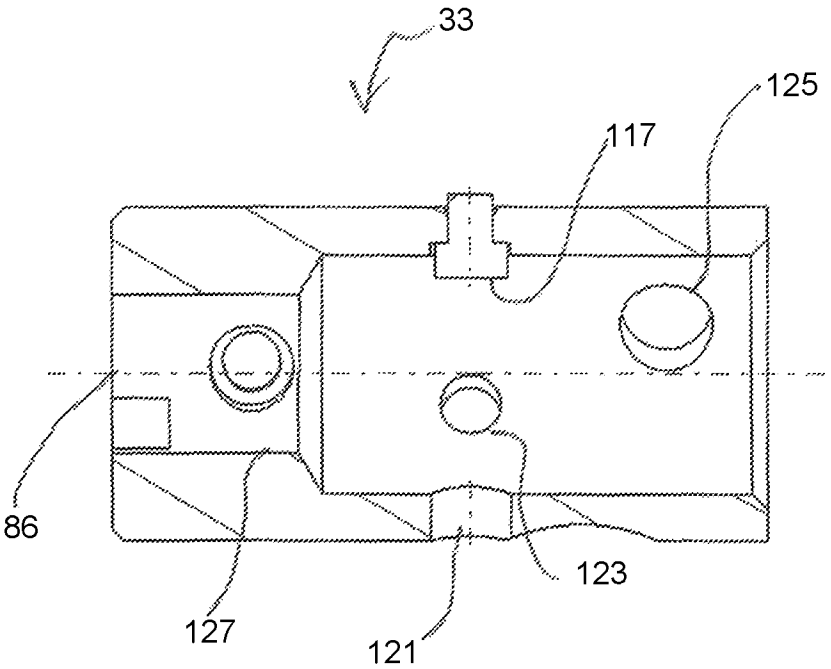
FIG. 13*b* is a cross-sectional view of the gas adjustment sleeve of FIG. 13*a*.
Figure 13A:
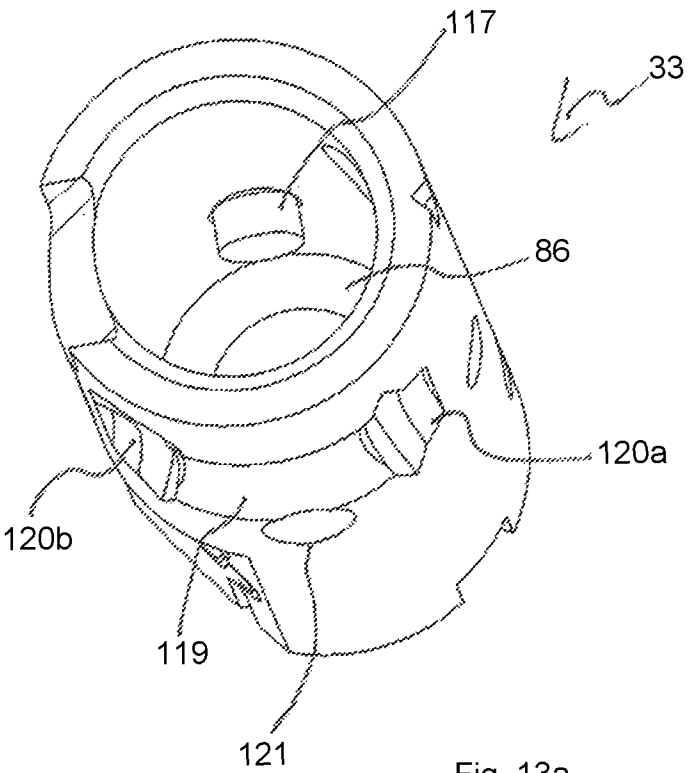
FIG. 13*a* is a perspective view diagonally from the front below of a gas locking sleeve.

On the front of the gas feed 5 a gas adjustment apparatus in the form of a gas adjustment sleeve 33 is attached (cf. in particular FIGS. 13*a, b* and 15-21). Roughly between the mounting portion 25 and gas adjustment sleeve 33 a molded spring 35 extends to the rear below the gas adjustment sleeve 33, which can be inserted in bearings 37*a, b* on the gas feed 5 (cf also FIG. 14-21). The molded spring, in cooperation with the bayonet breech, is used to index and fix the gas adjustment sleeve 33. To the rear a closure element 39 (e.g., a cover) adjoins the gas feed 5, which receives a short stroke gas piston not shown here in a gas cylinder 42 not shown in FIG. 2 and fixes it there (cf inter alia FIGS. 5, 9, 18, 20 and 22). The short stroke gas piston 43 penetrates the closure element 39 and is surrounded on its outer end by a closing cap 41 fixed there (cf also FIGS. 5, 7, 8 and 9-11).

Figure 4A:
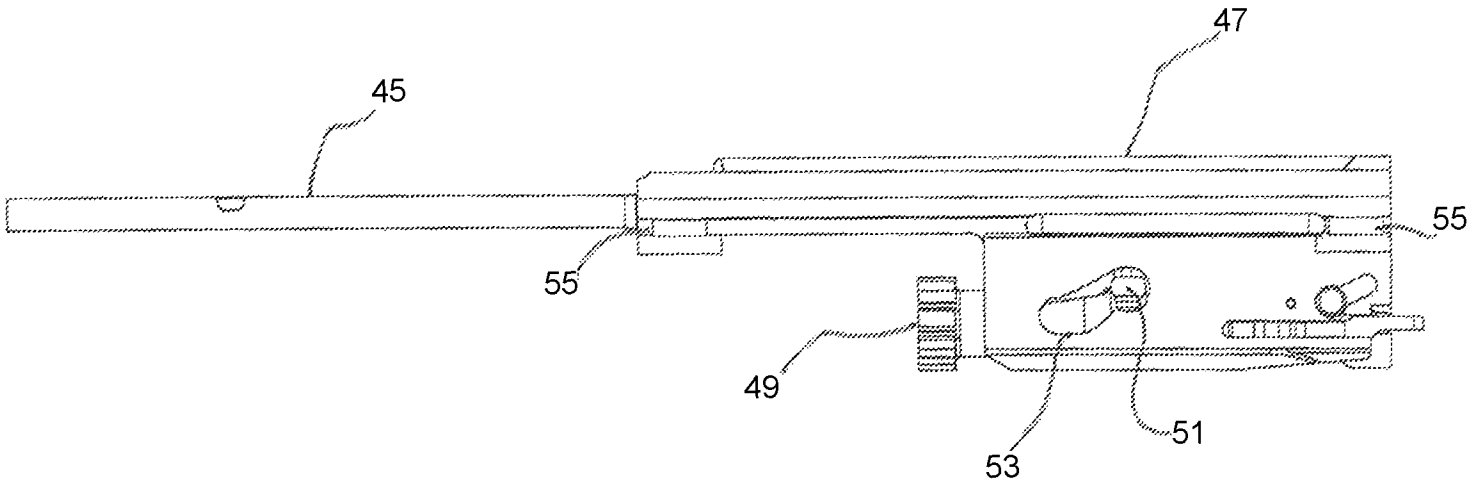
FIG. 4*a* is a lateral view of the breech block assembly of FIGS. 2-3.

In FIG. 2 a gas piston rod 45 (e.g., a gas piston bar) abuts the closing cap 41 prior to firing. The gas piston rod 45 is firmly connected to the breech block carrier 47 (e.g., a bolt carrier) of the breech block assembly 19 (cf also FIG. 4*a*). After firing and diversion of the propellant gases once a projectile has passed the barrel bore 99, the propellant gas drives the short stroke gas piston 43, so that it moves to the rear in the direction of the shoulder support stock 21 of the firearm. The short stroke gas piston 43 in the process transmits the received impulse to the gas piston rod 45 and drives it with the connected breech block assembly 19 to the rear in the direction of the shoulder support stock 21 of the firearm.

Figure 3:
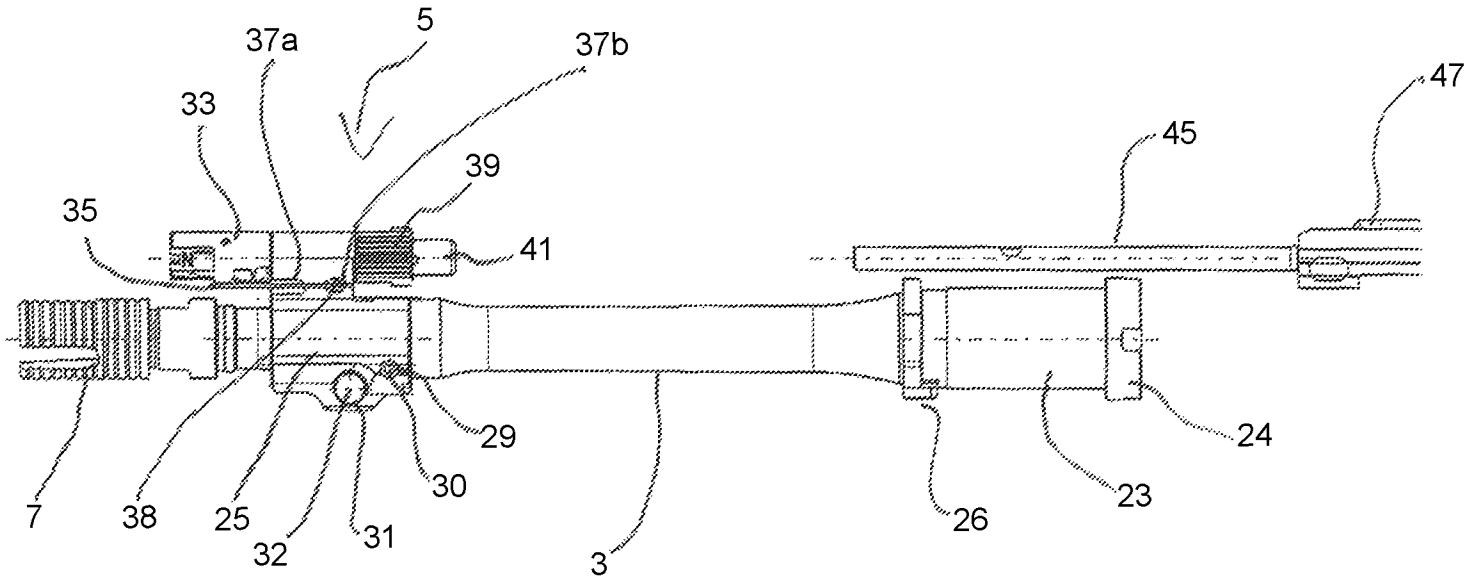
FIG. 3 is a lateral view of the gas feed of FIG. 2 after firing the automatic firearm.

FIG. 3 shows the gas piston rod 45 and the breech block carrier 47 after firing in its rearmost position. The cover or closing cap 41 and gas piston rod 45 are separate from one another. As a result, the short stroke gas piston differs substantially from other gas pistons, which are coupled or connected to the gas piston rod or the breech block support and return jointly with them after firing in the direction of the shoulder support stock 21 of the firearm.

Figure 4B:
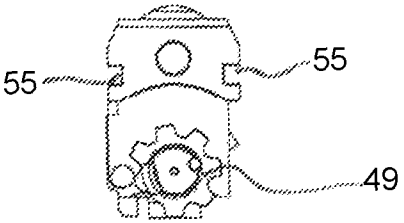
FIG. 4*b* is a front view of the breech block assembly of FIG. 4*a*.

FIG. 4 shows a detailed representation of the breech block assembly 19. The breech block carrier 47 is coupled in its front end to the gas piston rod 45. On its underside it comprises a breech block head 49 (e.g., a bolt head) longitudinally displaceable in its interior and rotationally guided. Said breech head comprises a control bolt 51 guided in a control guide 53 for locking and unlocking in known manner.

Figure 5:
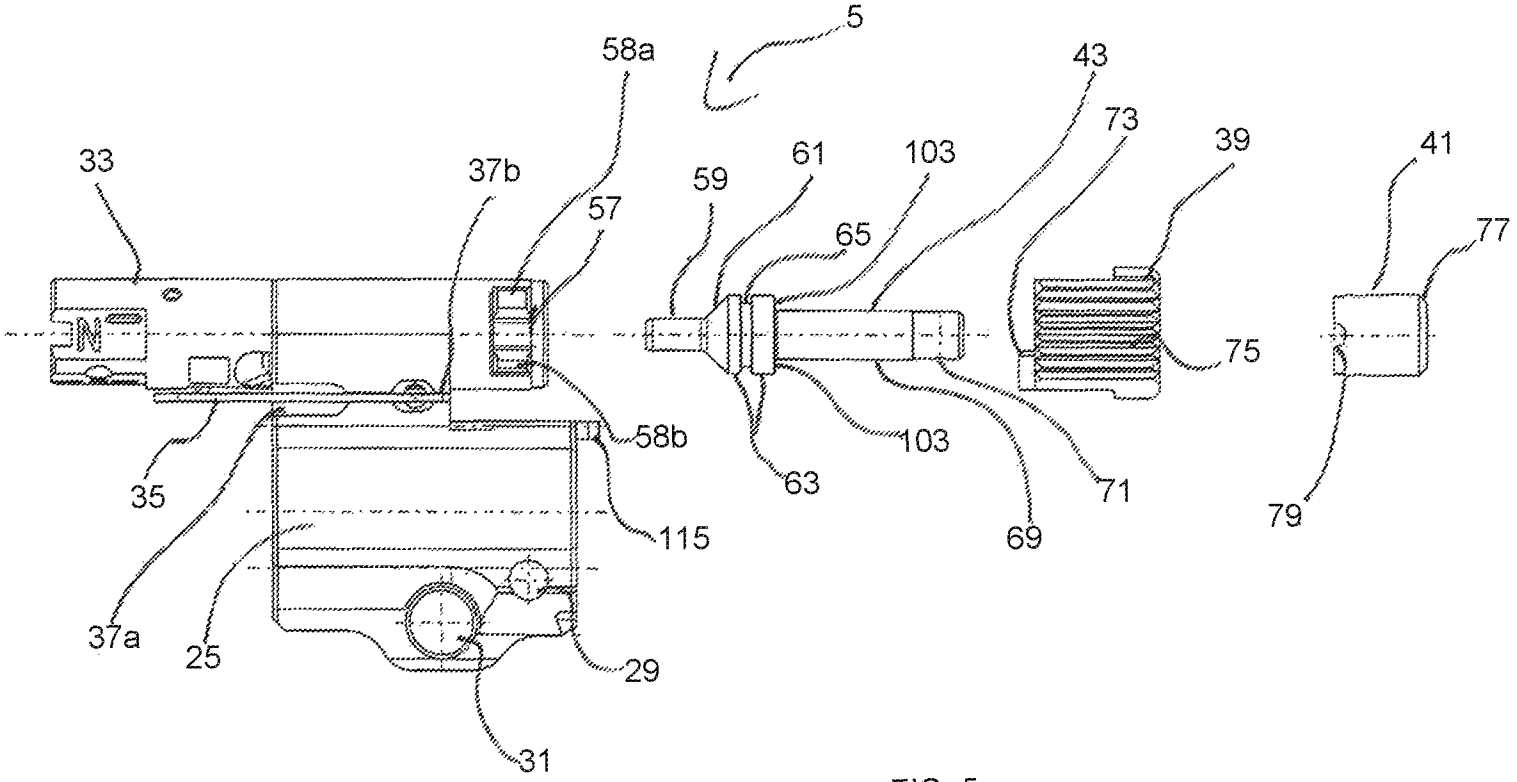
FIG. 5 is a partially exploded lateral view of the gas feed of FIGS. 1-3.

FIG. 5 shows a partially exploded view of the gas feed 5 from FIGS. 1 to 3. The gas piston or short stroke gas piston 43 is removed from the gas cylinder 42 and decoupled from the closure element 39 and the closing cap 41. Roughly in the rear end of the gas feed 5 a fastening section 57 (e.g., a bayonet joint) extending roughly perpendicular to the longitudinal direction is provided in the section surrounding the gas cylinder 42 for locking the cover or closure element 39. The closure element 39 has to this end a counter locking section in its interior (cf. FIG. 7). The two locking sections fix the closure element 39 to the gas feed 5 in the manner of a bayonet breech. The edges of the gas feed 5 extending in the direction of the shoulder support stock 21 of the firearm are beveled for an easier attachment of the closure element 39.

The short stroke gas piston 43 comprises on its front, muzzle-side end a gas piston nose 59 (e.g., a valve pin) for longitudinally displaceable guiding and sealing in a multi-stage gas passage 105, which extends to the muzzle in elongation of the gas cylinder 42. The gas piston nose 59 is conically beveled on its front end for an easy insertion into the multi-stage gas passage 105. The short stroke gas piston 43 widens to the rear in the direction of the stock into a conical section 61 and transitions adjacent to a bearing segment 63 with a rotary annular groove 65. The outer dimensions of the bearing segment 63 are roughly complementary to the inner dimensions of the gas cylinder 42. A sealant 67, in particular in the form of three sealing rings, is inserted into the rotary annular groove 65, in order to seal the short stroke gas piston 43 against the gas cylinder 42. During a longitudinal movement of the short stroke gas piston 43 within the gas cylinder 42 the sealant 67 also has a cleansing effect, since they expel contaminants on the gas cylinder 42 forward.

The bearing segment 63 transitions further in the direction of the stock in stepped manner to a tapered cylindrical section 69, which is provided on its rear end in a bearing segment 71 for assembly of the short stroke gas piston 43 on or with the closing cap 41. The bearing segment 71 comprises to this end a threaded section 40 (cf. FIG. 18) which can be bolted with a counter thread (not shown) in the interior of the closing cap 41. In addition, a locking pin 94 is provided, which secures the closing cap 41 in its position (cf FIGS. 18, 20 and 22). The closing cap 41 comprises on its underside semi-circular recesses 79.

In the mounted state or for assembly the short stroke gas piston 43 is initially inserted into the gas cylinder and then the cover or closure element 39 is attached and locked via the fastening section 57. The closure element 39 comprises on its outer circumference a largely rotary saw tooth tread design 75, which improves the grip of the closure element 39, in particular with gloves or under adverse conditions. On its front end facing the barrel muzzle the closure element 39 comprises an extension 73 extending partially forward (cf in particular FIGS. 7, 11 and 12, 15). The closure element 39 has a roughly U-shaped profile (cf FIG. 7). A pin 115 is used to position the gas feed 5 on the firearm barrel 3.

Figure 6:
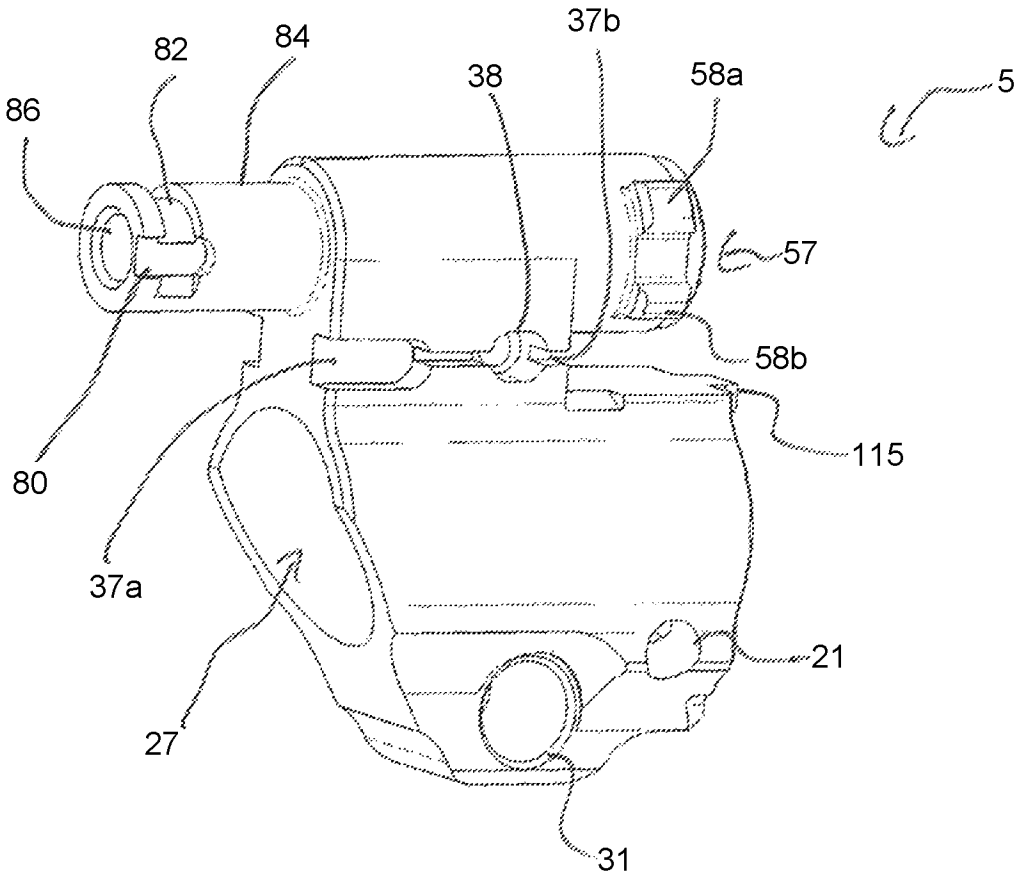
FIG. 6 is a perspective view diagonally from below to the front of the gas feed of FIG. 5.

FIG. 6 shows a perspective representation of the gas feed 5, in which the bearing 37*a* and *b* are shown enlarged. The bearing 37*a* adjoins a bore 38, which transversely penetrates the gas feed 5. The bore 38 is used to lock/release 135*a, b* the molded spring.

The bearings 37*a, b* are used to insert the molded spring 35. On the front end of the gas feed 5 toward the barrel muzzle a cylindrical receiving portion 84 is provided for the gas adjustment sleeve 33. In the interior of the cylindrical receiving portion 84 a gas outlet 86 is provided by the gas cylinder 42. An insertion section of a bayonet breech guide 80 is provided to receive a complementary pin 117 (cf FIG. 13*a* and *b*) and transitions to an annular bayonet guide section 82, which is used to fix the gas adjustment sleeve 33 to the gas feed 5 via the complementary pin 117. The molded spring 35, in cooperation with this bayonet breech is used to index and fix the gas adjustment sleeve 33.

Figure 7:
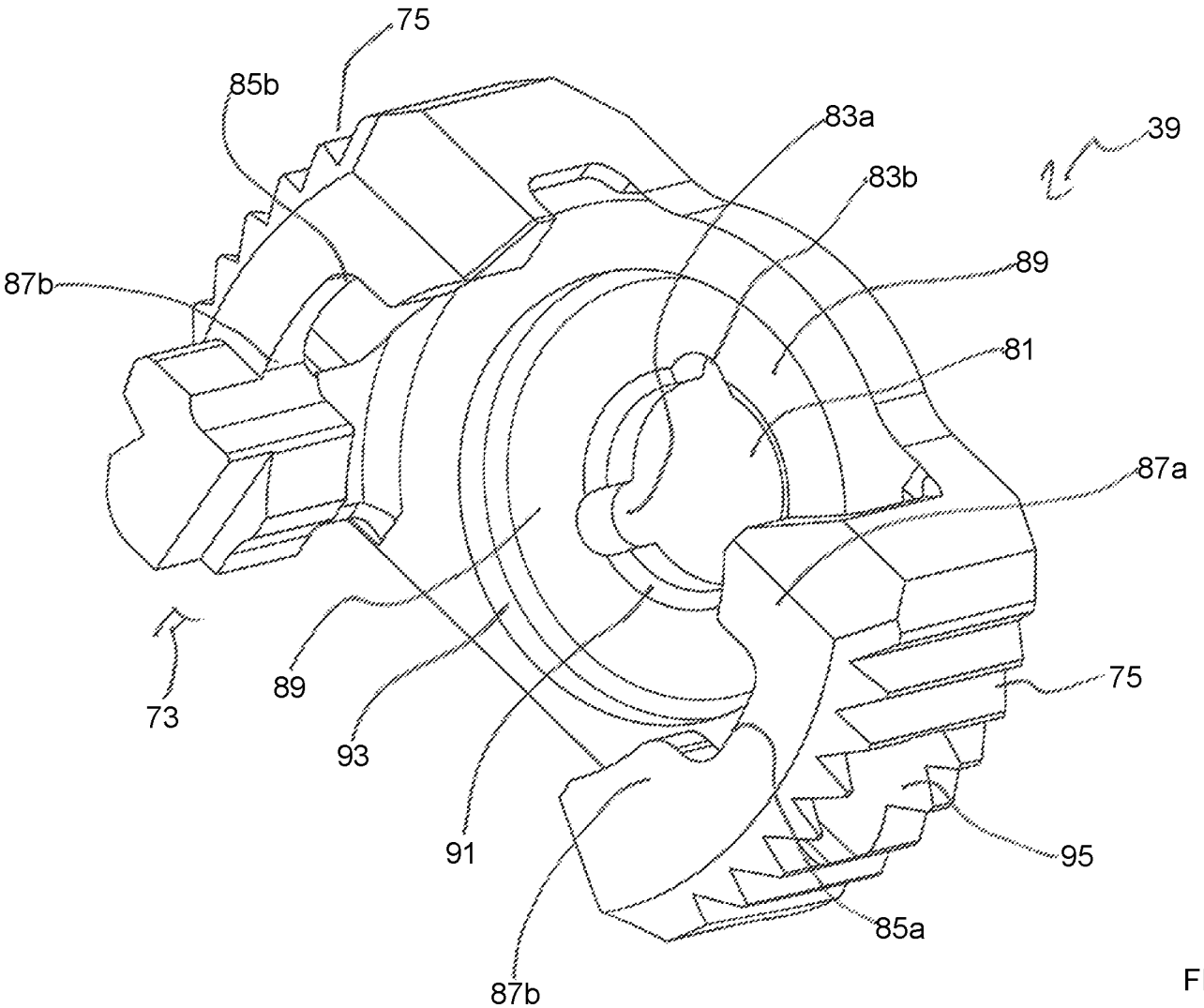
FIG. 7 is a perspective view diagonally from the front above of a closure element/cover.

FIG. 7 shows a detailed representation of the cover or closure element 39 with its inner passage 81 for the short stroke gas piston 43. The passage 81 widens conically to its edge and thus forms a conical insertion section 91 for the passage of the short stroke gas piston 43. The passage 81 has on its circumferential edge semi-circular bores or openings 83*a* and *b*, which are used to remove particles of dirt and contaminants. This action ensures full function of the gas feed 5 even under adverse circumstances.

The closure element 39 comprises in its U profile two extensions extending in the direction of the muzzle, which have a locking section 87*a, b* in their interior for engagement with the fastening section 57 on the gas feed 5. To this end, two attachment sections or insertion sections 85*a* and *b* are provided, which can be attached to the locking projections 58*a, b* in the fastening section 57 (cf. FIG. 12) and are rotated after attachment in their locking position (cf FIG. 11). FIG. 11 shows the closure element 39 in its attachment position and FIG. 10 in its locking position. The locking sections 87*a, b* adjoin the insertion sections 85*a, b*, said locking sections which, as a bayonet breech encompass the locking projections 58*a, b* and thus fix the closure element 39 on the gas feed 5.

Figure 11:
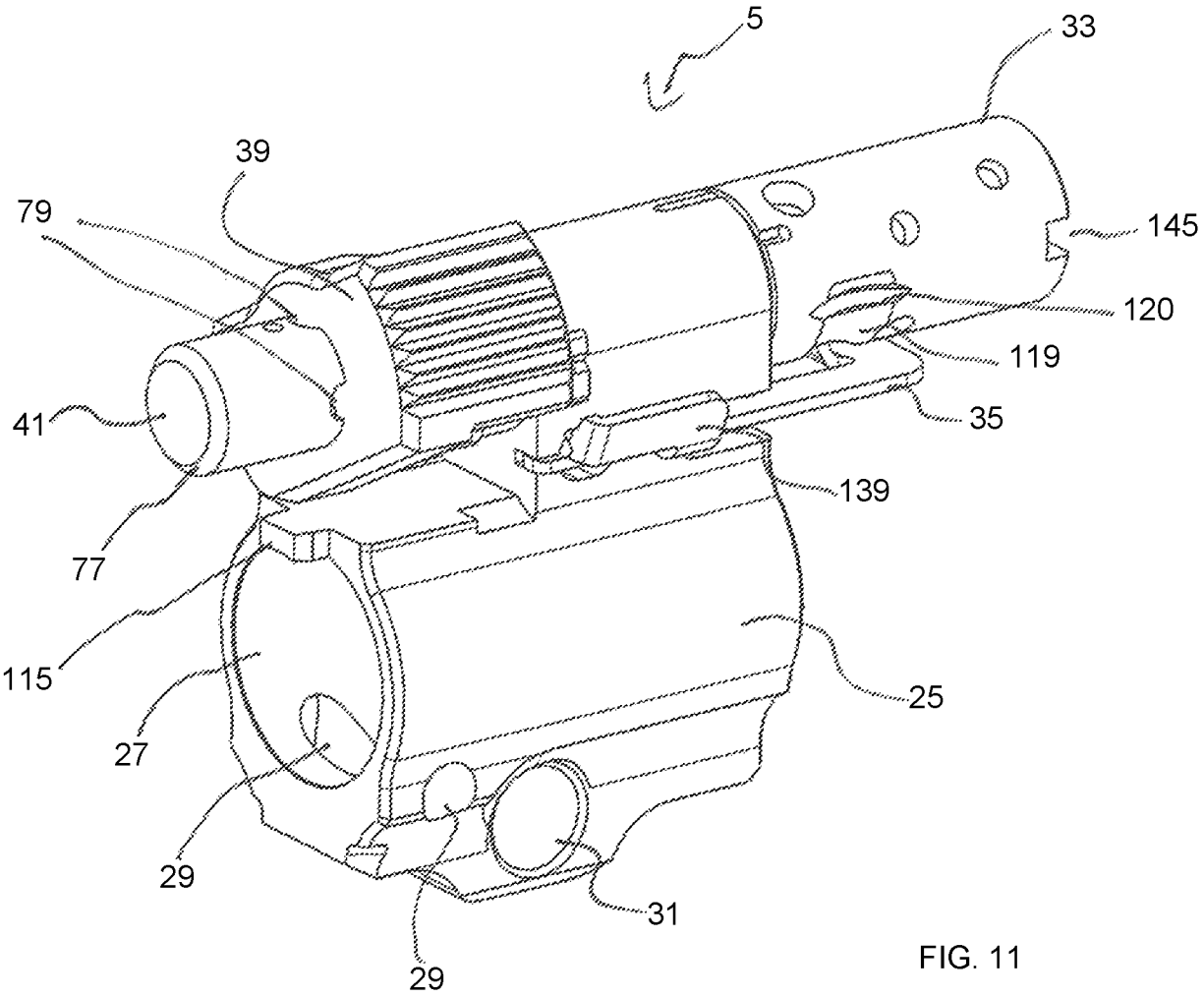
FIG. 11 is a perspective view of the gas feed of FIGS. 10 in an unlocked state.
Figure 12:
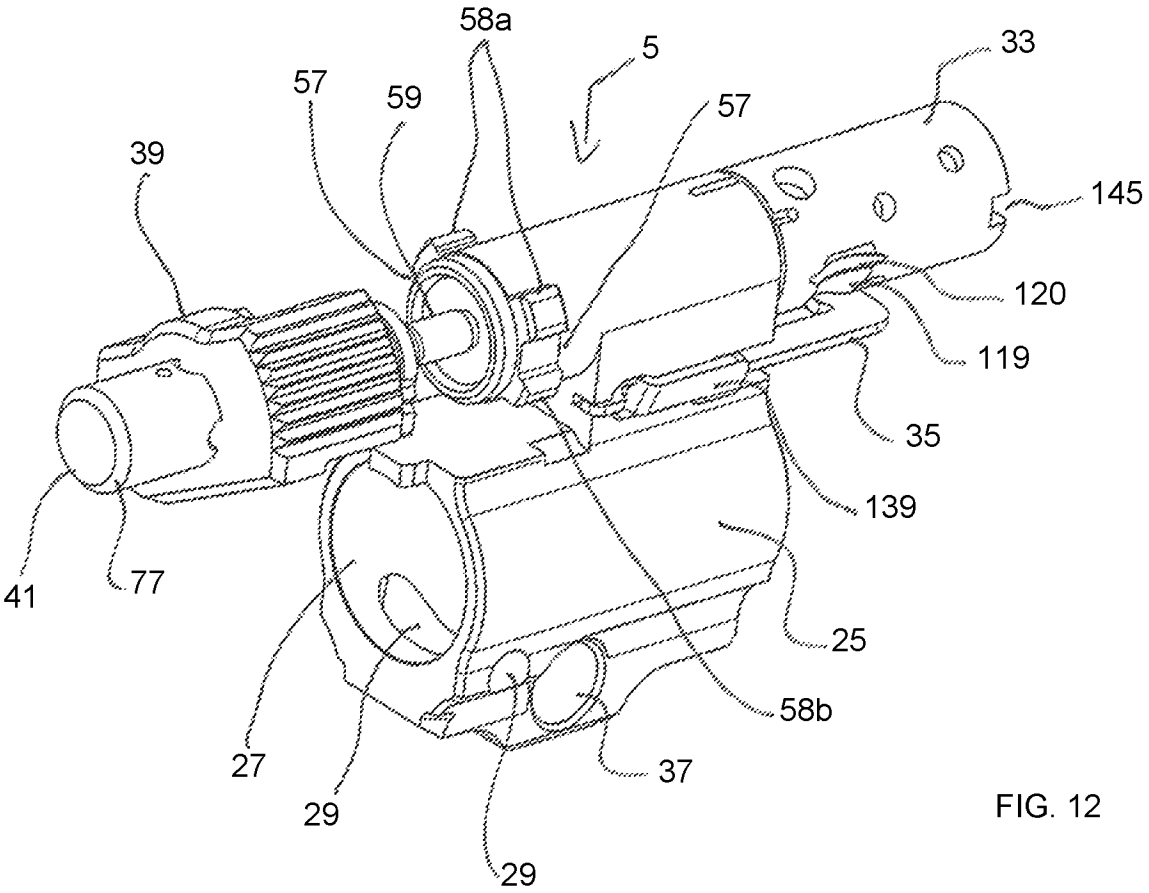
FIG. 12 is perspective view of the gas feed of FIG. 11 an unlocked and partially disassembled state.
Figure 15:
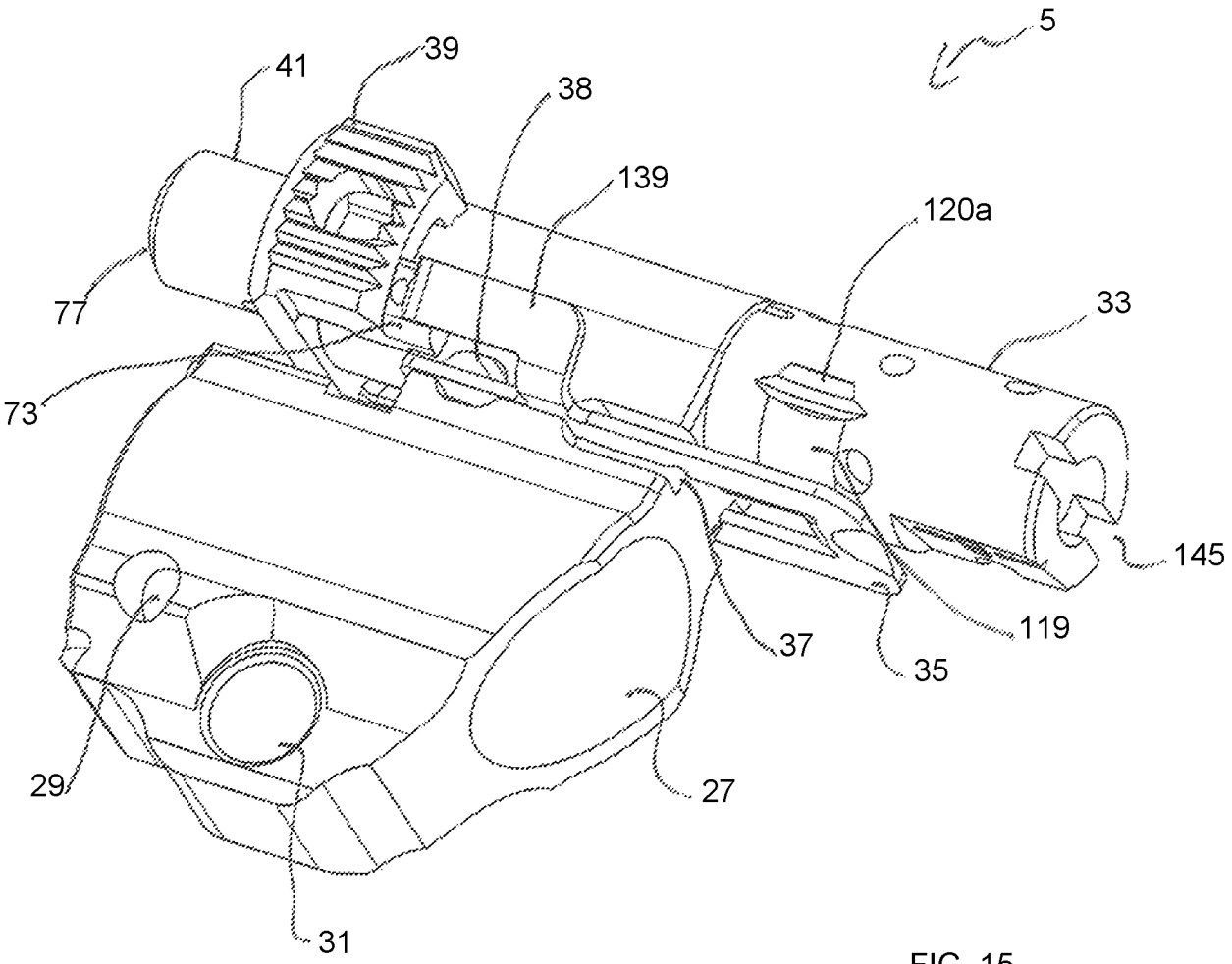
FIG. 15 is a perspective view diagonally from the front below of the molded spring used in the gas feed of FIGS. 1-3.
Figure 16:
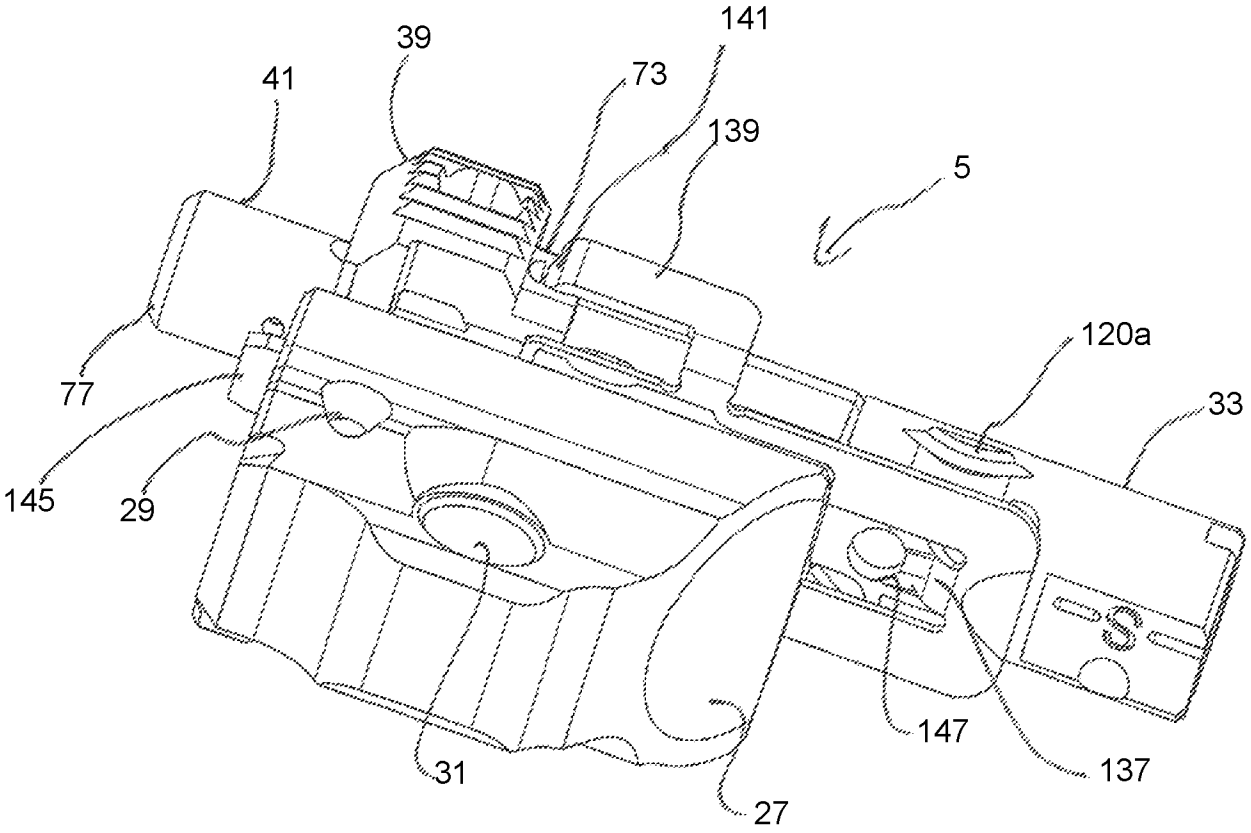
FIG. 16 is a perspective view diagonally from below of the gas feed of FIG. 15.

An extension 73 is configured on the upper locking section 87*b* in FIG. 7 which, with a lock provided on its exterior, is used for indexing the molded spring (cf FIGS. 11, 12 and 15).

Figure 8:
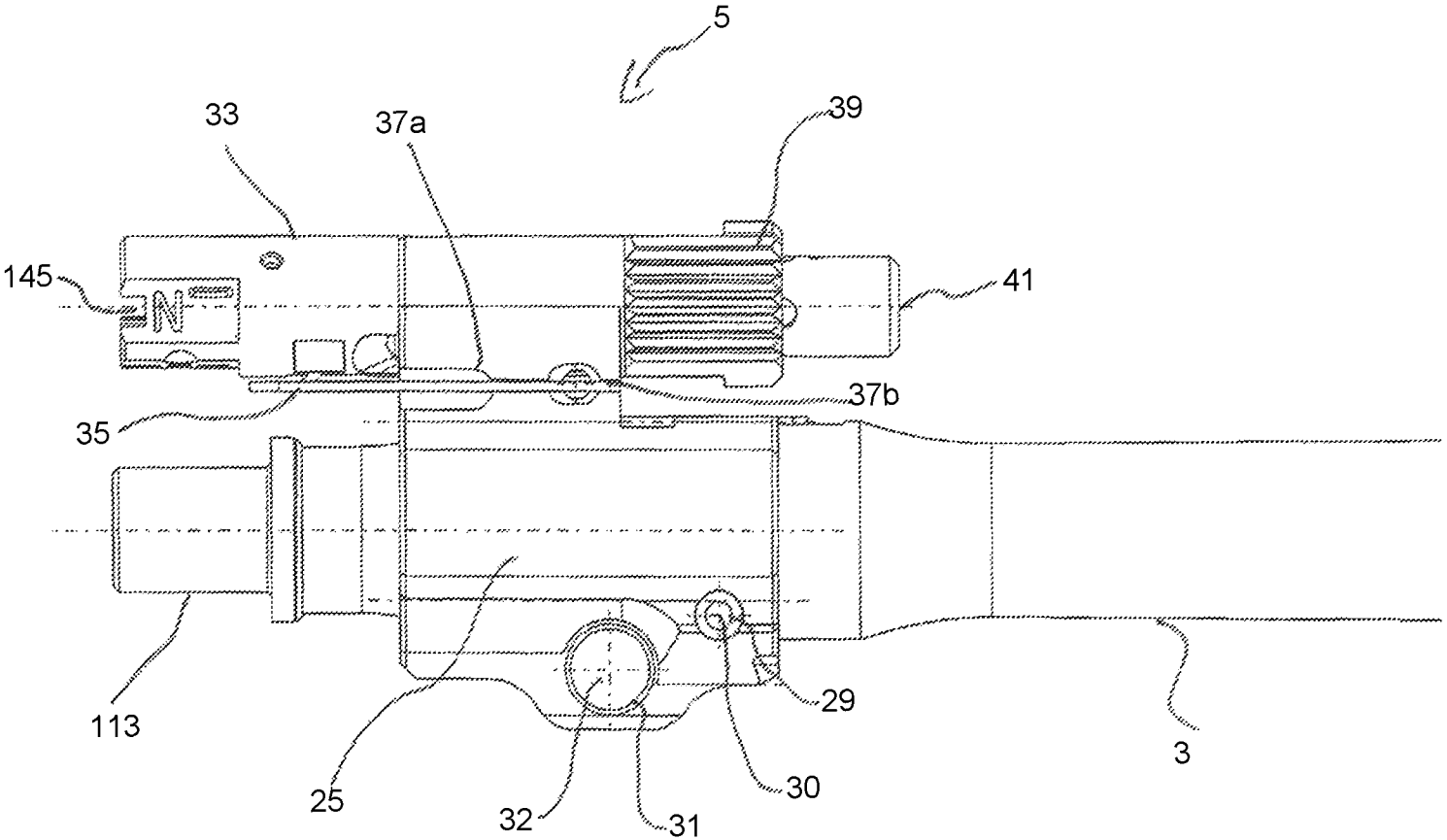
FIG. 8 is a lateral view of the gas feed of FIGS. 5-6 mounted on the firearm barrel.
Figure 9:
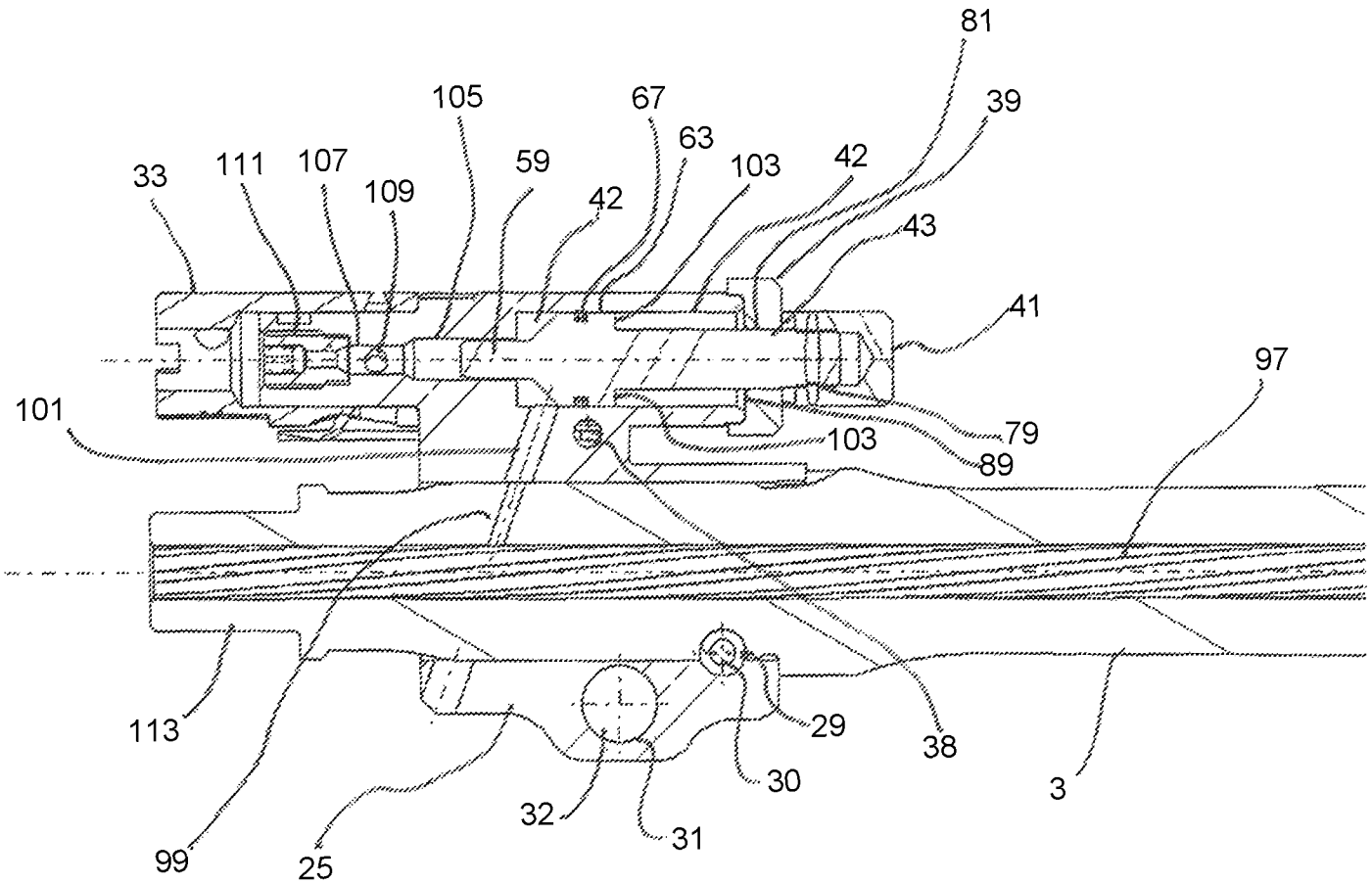
FIG. 9 is a cross-sectional view of the gas feed and the firearm barrel of FIG. 8.

FIG. 8 shows a lateral view of the gas feed 5 mounted on the firearm barrel 3 and FIG. 9 shows a longitudinal section view. Within an inner wall of the barrel or barrel bore 97 there are known grooves and lands, to spin a projectile. On the muzzle section of the firearm barrel 3 a bearing segment 113 is provided to accommodate and fix the flash suppressor 7, for example via a threaded section (not shown). On the side of the firearm barrel 3 facing the gas feed 5 a barrel bore 99 extends diagonally in longitudinal direction, through which propellant gases are diverted to the gas feed 5 after firing and passage of a projectile. A gas bore or gas channel 101 is provided in the gas feed, said gas bore or gas channel likewise running diagonally to the longitudinal direction and running on its upper side to the gas cylinder 42 in roughly the region of the conical section 61 of the short stroke gas piston 43.

In FIG. 9 the short stroke gas piston 43 is in its resting position prior to firing. The gas piston nose 59 is located within the multi-stage gas passage 105 and seals it forward to the muzzle The gas piston nose 59 is used for gas pressure regulation and for ventilation of excess propellant gases in the direction of the muzzle, which releases the gas cylinder 42 after a specified return path of the gas piston 43, whereupon the gas cylinder 42 is ventilated and no further essential acceleration of the gas piston takes place and the excess propelling charge gases can escape via a gas passage with the gas outlet nozzle 111 with a predetermined small diameter forward in the direction of the muzzle The sealant 67 is provided within the rotary annular groove 65 and the bearing segment 63 transitions on its stock-side end in stepped manner to the cylindrical section 69. The step forms a stop surface 103, which strikes the counter stop surface 89 in the closure element or closure element 39 after firing to limit the movement of the short stroke gas piston 43.

The multi-stage gas passage 105 transitions at its front to the muzzle in a stepped extension to a gas channel 107, which comprises a lateral gas outlet bore 109. In the direction of the muzzle the gas channel 107 transitions to gas outlet nozzle 111 with an outlet nozzle, in order to ventilate excess propellant gases outward. The gas outlet nozzle 111 is a carbide nozzle. This carbide sleeve is resistant to erosion and serves as a nozzle for controlled outflow of the propelling charge gases.

Figure 10:
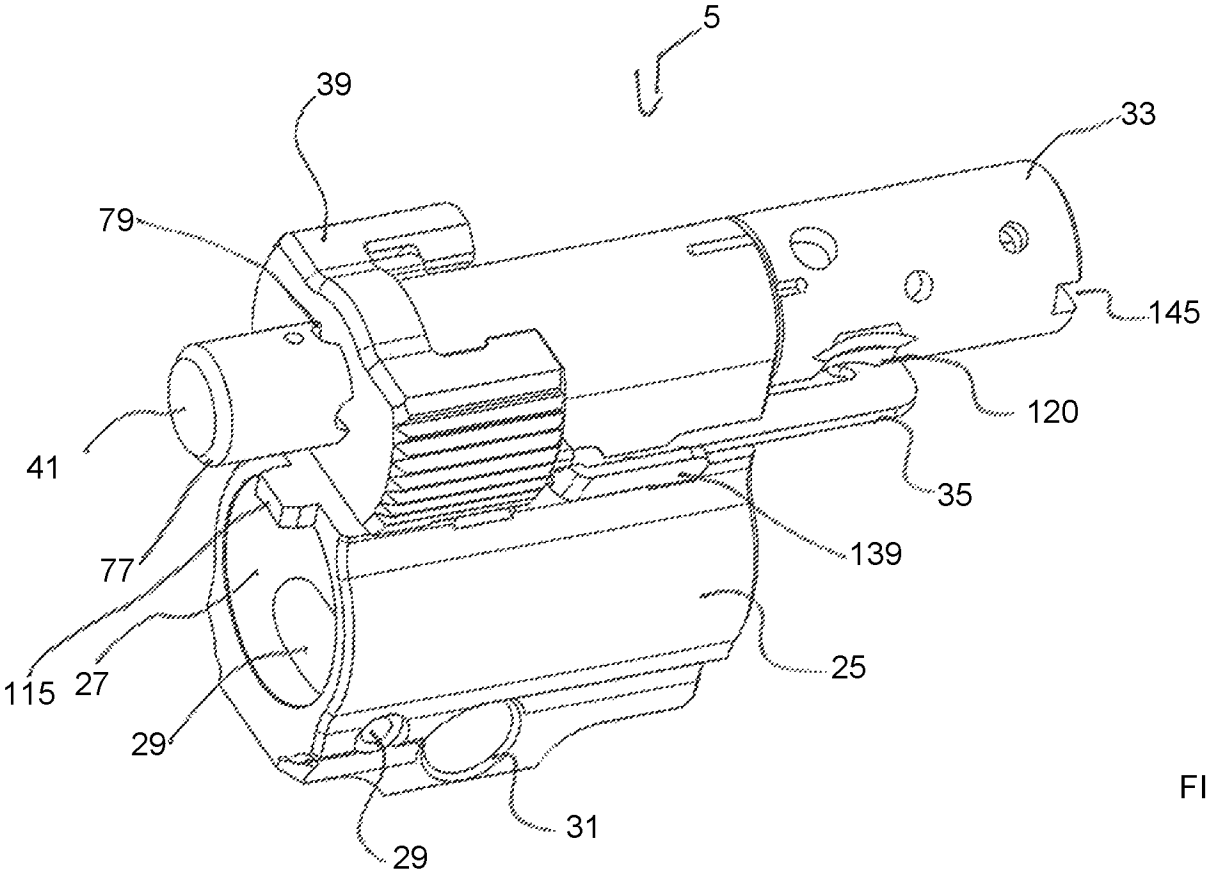
FIG. 10 is a perspective view diagonally from the rear above of the gas feed of FIGS. 1-3 in a locked state.

FIG. 10 shows the closure element 39 on the gas feed 5 in a locked state. FIG. 11 shows the unlocked diagonally attached closure element 39. In this position the closure element 39 can be removed to the rear in the direction of the stock. In FIG. 12 the short stroke gas piston 43 has been virtually completely removed from the gas cylinder 42 and the cylindrical gas piston nose 59 can be recognized. In addition, the locking projections 58*a* and *b* of the fastening section 57 arranged in pairs opposite one another are shown.

FIG. 13*a* shows a perspective view of the gas adjustment sleeve 33 and FIG. 13*b* shows a longitudinal section view. On the upper side a complementary pin 117 penetrating the gas adjustment sleeve 33 is inserted, said pin being mounted from above in a bore. This complementary pin 117 is used for bayonet locking the gas adjustment sleeve 33 on the cylindrical receiving portion 84 of the gas feed 5. On the lower outside of the gas adjustment sleeve 33 a semi-circular latching recess 119 running perpendicular to the longitudinal direction is provided, which has on its ends indexing positions for a latching nose 137 on the molded spring 35. The molded spring 35 engages positively with a lock 120*a, b*.

On the underside of the gas adjustment sleeve 33 a bore 121 penetrating the gas adjustment sleeve 33 is provided roughly at the height of the complementary pin 117. Above this a further bore 123 is provided and adjacent to it a further somewhat larger bore 125, which serves as a gas outlet opening for gas adjustment of the gas adjustment sleeve 33. The inner bore of the cylindrical gas adjustment sleeve 33 is configured complementary to the cylindrical receiving portion 84 (cf. FIG. 6), tapers forward conically and transitions to a step section 127, which serves as a gas outlet for excess propellant gases.

Figure 14:
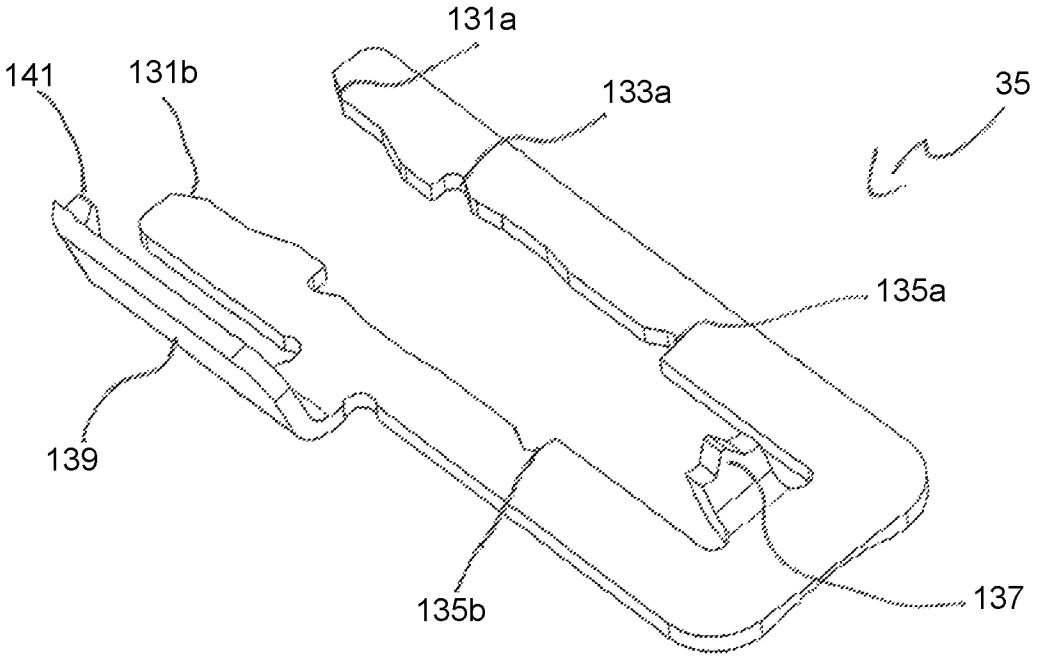
FIG. 14 is a perspective view diagonally from the front above of a molded spring.

FIG. 14 shows the molded spring 35, comprising diagonal insertion sections 131*a, b* on its front muzzle-side end, said diagonal insertion sections facilitating an assembly of the molded spring 35 on the gas feed 5. Stops 133*a, b* and 135*a* and *b* serve as stop and lock-in positions, which lock the molded spring 35 on the gas feed 5. A latching nose 137 is provided on the end of the molded spring 35 facing the shoulder support stock 21 of the firearm, said locking projection being used to index the gas adjustment sleeve 33 in the locks 120*a, b* of the latching recess 119 on the gas adjustment sleeve 33. On the right side, viewed in the direction of fire, the leg of the U-shaped molded spring 35 extends outward upward and to the rear to a plunger lug 139, which extends forward in longitudinal direction parallel to the U-shaped leg of the molded spring 35 and has a further latching nose 141 on its front. The plunger lug 139 extends roughly at a right angle parallel to the gas feed 5 and the latching nose 141 indexed on the extension 73 of the closure element 39 (cf. also FIGS. 15 and 16). A bore 147 is shown on the underside in FIG. 16 of the gas feed 5. The gas adjustment sleeve 33 has a slot 145 running transversely on its muzzle-side front and is used for making adjustments, also by means of tools.

Figure 17:
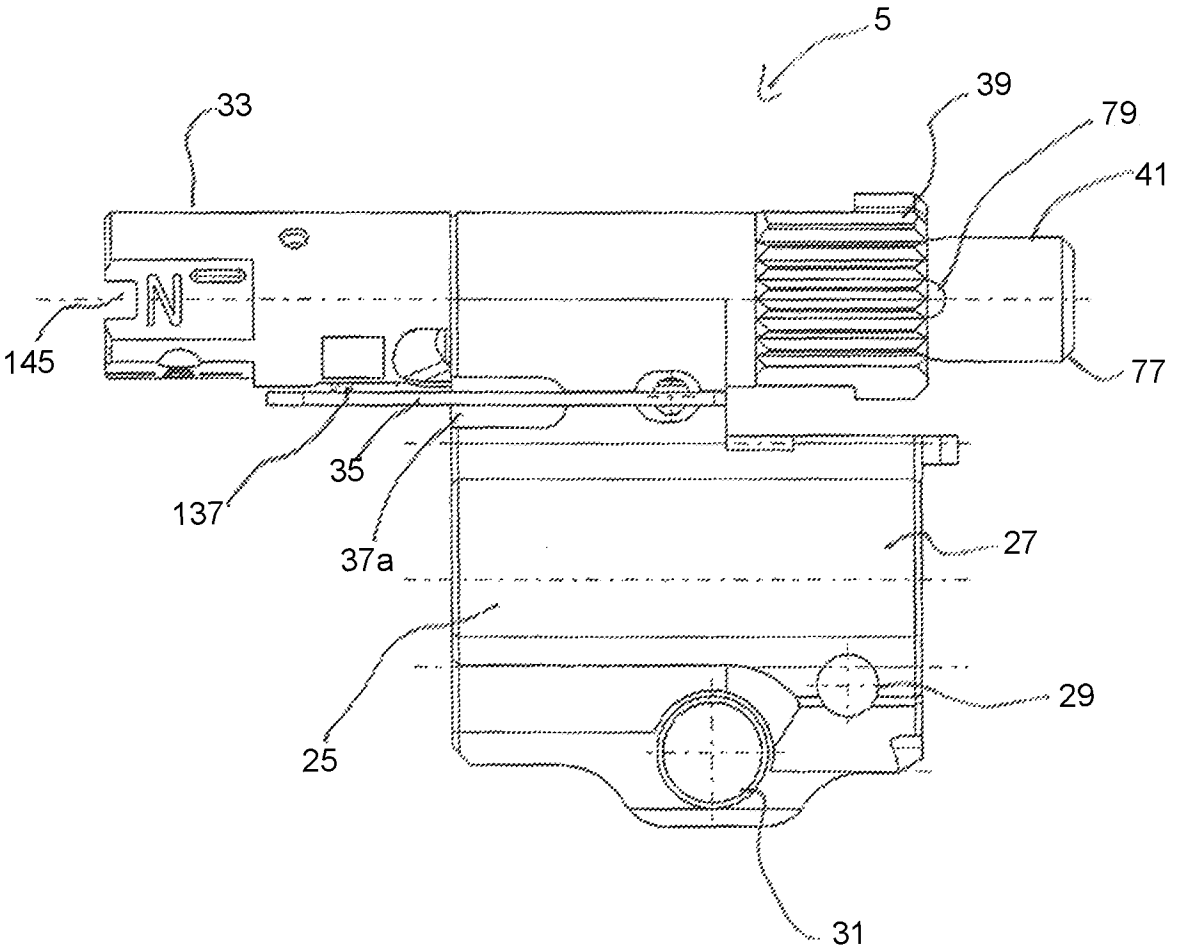
FIG. 17 is a lateral view of the gas feed of FIGS. 1-3 in a position "N" of the gas adjustment sleeve.
Figure 18:
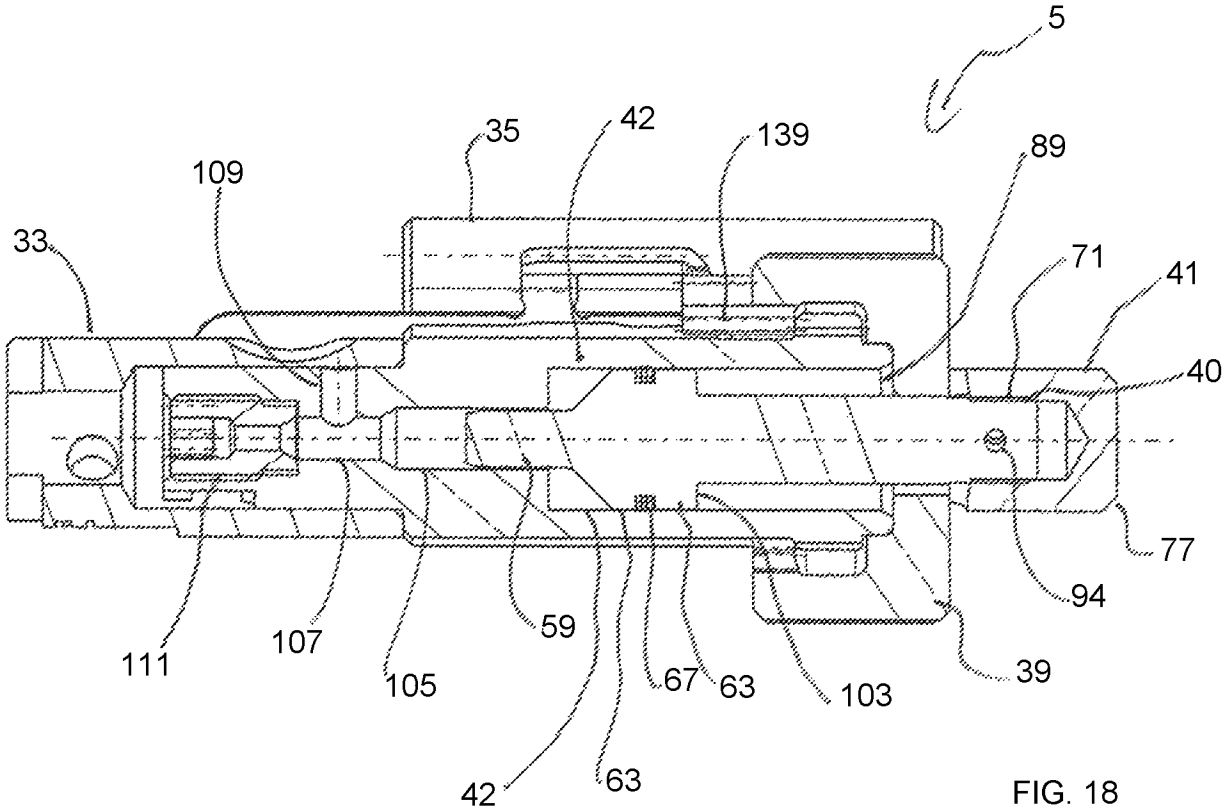
FIG. 18 is a cross-sectional view of the gas feed of FIG. 17.
Figure 19:
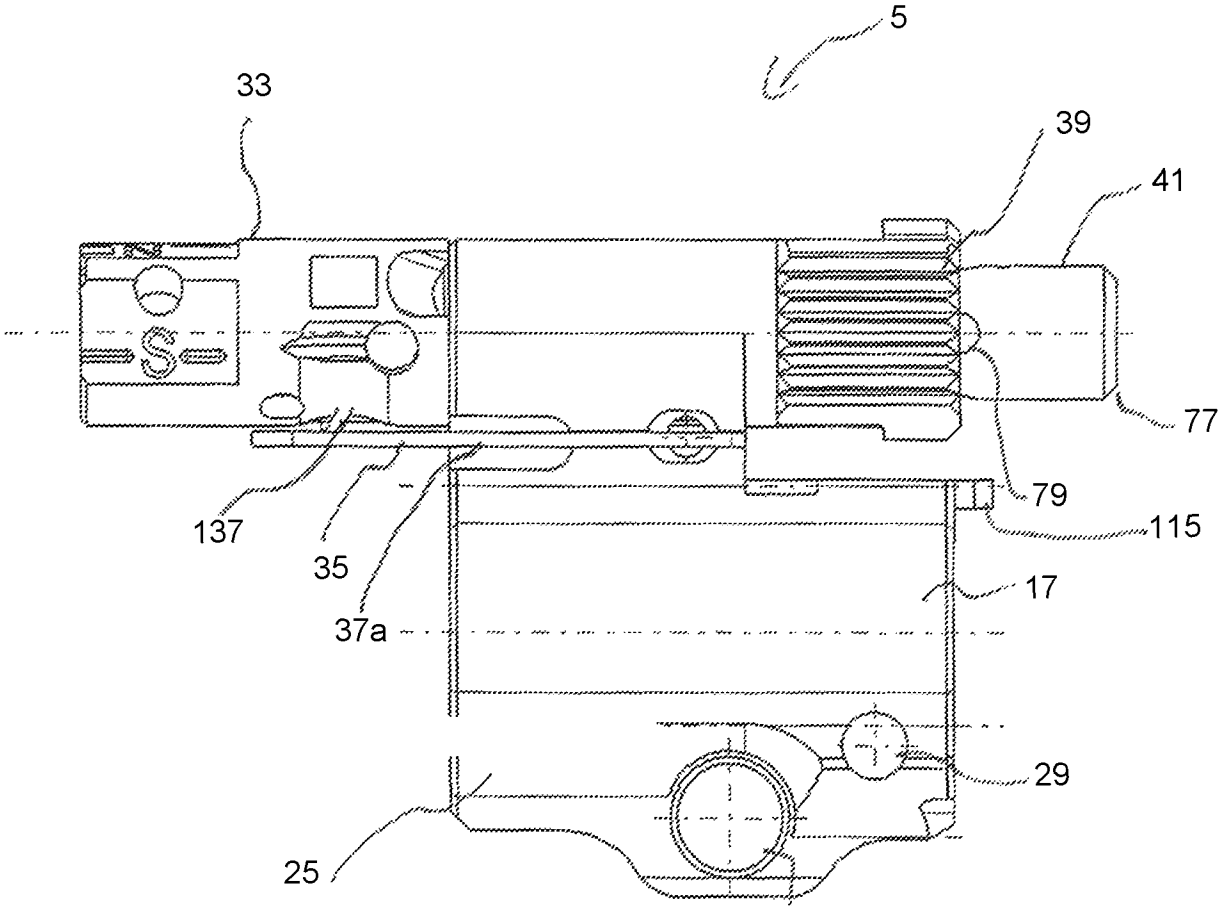
FIG. 19 is a lateral view of the gas feed of FIG. 17 in a position
Figure 20:
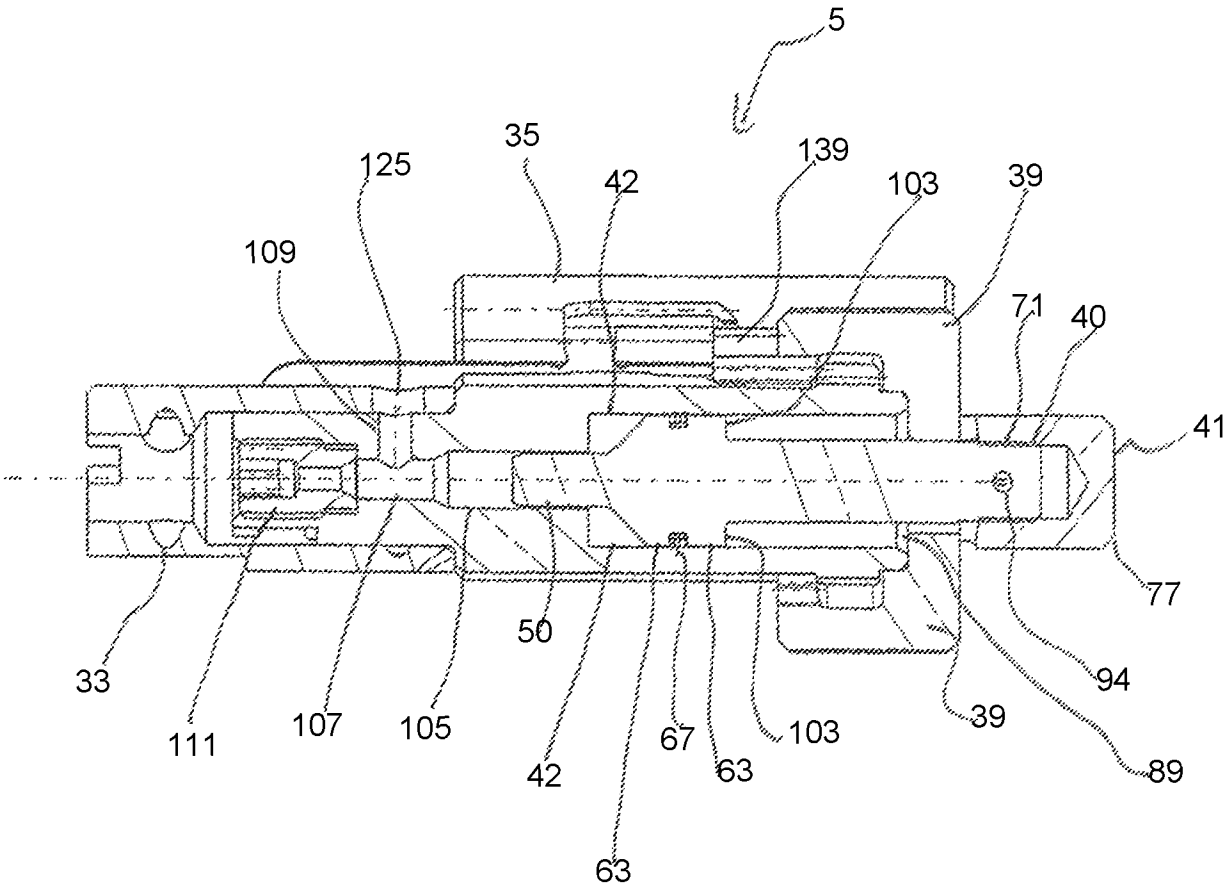
FIG. 20 is a cross-sectional view from above of the gas feed of FIG. 19.

FIG. 17 shows the gas feed 5 with the gas adjustment sleeve 33 in the position "N" (normal operation) and FIG. 18 shows a corresponding longitudinal section view in a view from above. FIG. 19 shows the gas adjustment sleeve 33 in its position "S" (silencer operation) and FIG. 20 shows an associated longitudinal section representation in a view from above. To adjust the gas adjustment sleeve 33 it is turned either with a tool in the slot 145 or by hand by about 90° between the positions "N" and "S". In the process, the latching nose 137 of the molded spring 35 glides along the latching recess 119 from lock 120*a* position to lock 120*b* position. Simultaneously the complementary pin 117 glides within the annular bayonet guide section 82.

The two positions "N" and "S" differ substantially in that the gas outlet bore 109 in FIG. 18 is closed on its upper side or outside via the lateral wall of the gas adjustment sleeve 33 and in FIG. 20 aligns with the gas outlet opening or bore 125 in the gas adjustment sleeve 33, so that ventilated or ventilating propellant gases are released both via this lateral gas outlet and via the front valve nozzle in the gas outlet nozzle 111, in order to ensure the firearm function when a silencer (not shown) is used and to prevent hyperfunctions or malfunctions of the silencer. Since the carbide insert of the outlet nozzle has a passage with a defined small cross-section, the lateral gas outlet eases the load and thus causes faster ventilation, which is only open in the silencer position.

Figure 21:
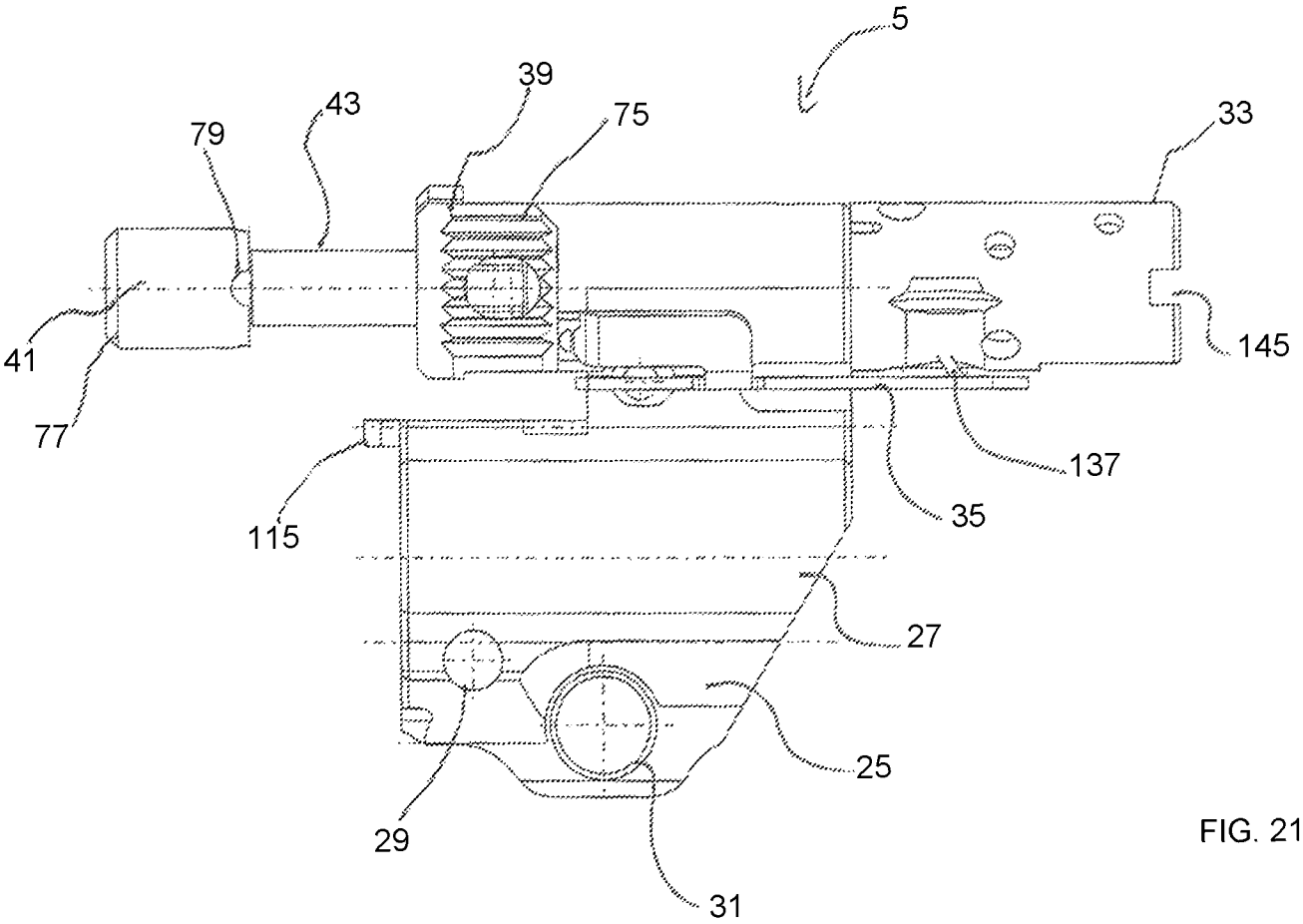
FIG. 21 is a lateral view of the gas feed of FIGS. 17-19 with a completely extended short stroke gas piston.
Figure 22:
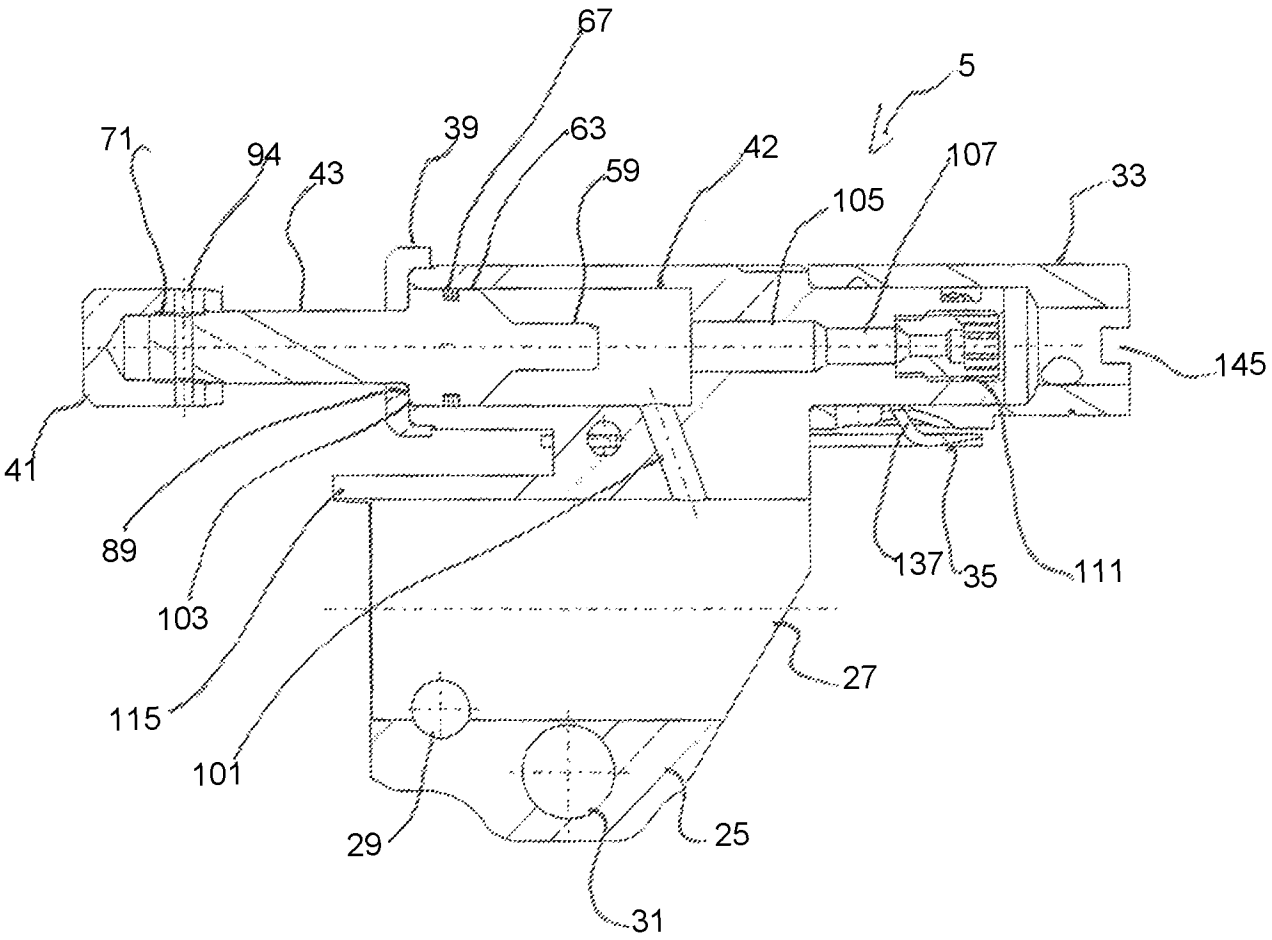
FIG. 22 is a cross-sectional view of the gas feed of FIG. 21.

FIG. 21 shows a lateral view of the gas feed 5 with an extended short stroke gas piston 43. The stock-side end with the closing cap 41 in FIGS. 21 and 22 is located on the left side, also mirror-inverted to the previous figures. The annular stop surface 103 of the short stroke gas piston 43 adjoins the counter stop surface 89 in the closure element or closure element 39. In this position the gas piston rod 45 is already separated from the short stroke gas piston 43. In the forward motion of the breech block assembly 19 the gas piston rod 45 of the breech block carrier 47 engages on the cover or the closing cap 41 and propels the short stroke gas piston 43 back to its initial position. The cycle then begins anew when a shot is fired.

Further embodiments of the disclosure arise for a person skilled in the art from the dependent claims and the following drawings.

It is noted that this patent claims priority from DE Patent Application Serial Number 10 2017 002 165.1, which was filed on Mar. 7, 2017, and is hereby incorporated by reference in its entirety.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An automatic firearm gas feed comprising:

a gas cylinder connectable to a barrel bore inside a firearm barrel via a channel;

a gas piston disposed inside the gas cylinder to drive a gas operated reloading mechanism, wherein the gas piston is displaceable in a longitudinal direction with respect to the firearm; and a closure element that can be detachably coupled to an end of the gas cylinder adjacent a stock of the automatic firearm, wherein the closure element comprises a passage through which a gas piston can be disposed and an inner stop surface adjacent a counter stop surface of a gas piston bearing to limit return movement of the gas piston in a direction of the stock, a region of the inner stop surface of the closure element having at least one recess to divert contaminants.

2. The automatic firearm gas feed according to claim 1, wherein the gas piston comprises a gas piston bearing, and wherein the gas piston bearing comprises a sealant to seal the gas piston with respect to the gas cylinder.

3. The automatic firearm gas feed according to claim 1, wherein a fastening device is a fastening section on an outer circumference of the gas cylinder and adjacent to the stock, and wherein an interior of the closure element comprises a complementary fastening section, and wherein the fastening section and the complementary fastening section are bayonet joints.

4. The automatic firearm gas feed according to claim 3, wherein a connection between the gas piston and an attachment is secured by a safety element.

5. The automatic firearm gas feed according to claim 1, wherein the gas piston can be connected to an attachment via a fastening means on a bearing segment.

6. The automatic firearm gas feed according to claim 1, wherein a muzzle-side end of the gas piston comprises a gas piston nose, and wherein the gas piston nose can be at least partially stored within a cylindrical multi-stage gas passage in the gas feed to allow longitudinal displacement.

7. The automatic firearm gas feed according to claim 6, wherein the cylindrical multi-stage gas passage is fluidly coupled to a gas outlet nozzle to divert propellant gases in a direction of a muzzle and outside of a firearm.

8. The automatic firearm gas feed according to claim 1, wherein a muzzle-side end of the gas feed comprises a gas adjustment apparatus encompassing a muzzle-side section of the gas feed, and wherein the gas adjustment apparatus can be at least fluidly coupled to a gas outlet nozzle for outgassing.

9. The automatic firearm gas feed according to claim 8, wherein the gas adjustment apparatus can be detachably coupled to the gas feed via a fastening apparatus, and wherein the fastening apparatus is a bayonet joint.

10. The automatic firearm gas feed according to claim 8, wherein the gas adjustment apparatus can be adjusted and indexed between at least two gas regulation positions via a safety device.

11. The automatic firearm gas feed according to claim 10, wherein the safety device is a U-shaped molded spring that can be inserted and fixed in complementary bearings in the gas feed.

12. A firearm barrel comprising a gas feed, the gas feed comprising:

a mounting portion to fasten the gas feed on the firearm barrel;

a gas cylinder connectable to a barrel bore inside the firearm barrel via a channel;

a gas piston disposed inside the gas cylinder to drive a gas operated reloading mechanism, wherein the gas piston is displaceable in a longitudinal direction with respect to the firearm barrel; and a closure element that can be detachably coupled via a threaded connection to an end of a gas cylinder adjacent a stock of a firearm, wherein the closure element comprises a passage through which a gas piston can be disposed, a region of the closure element having at least one recess to divert contaminants.

13. An automatic firearm comprising a gas feed, the gas feed comprising:

a mounting portion to fasten the gas feed on a firearm barrel;

a gas cylinder connectable to a barrel bore inside the firearm barrel via a channel;

a gas piston disposed inside the gas cylinder to drive a gas operated reloading mechanism, wherein the gas piston is displaceable in a longitudinal direction with respect to the firearm; and a closure element that can be detachably coupled via a threaded connection to an end of a gas cylinder adjacent a stock of the automatic firearm, wherein the closure element comprises a passage through which a gas piston can be disposed, the closure element including an opening to receive a locking projection.

14. The automatic firearm according to claim 13, wherein the automatic firearm comprises a gas piston rod to detachably couple with the gas feed of the automatic firearm, and wherein a breech block assembly is disposed in the automatic firearm housing and coupled to the gas piston rod to allow longitudinal displacement.

* * * * *